US011575221B2

(12) United States Patent
Onodi

(10) Patent No.: US 11,575,221 B2
(45) Date of Patent: Feb. 7, 2023

(54) JUNCTION BOX

(71) Applicant: Woertz AG, Muttenz (CH)

(72) Inventor: Tamas Onodi, Thalwil (CH)

(73) Assignee: Woertz AG, Muttenz (CH)

( * ) Notice: Subject to any disclaimer, the term of this patent is extended or adjusted under 35 U.S.C. 154(b) by 0 days.

(21) Appl. No.: 17/331,288

(22) Filed: May 26, 2021

(65) Prior Publication Data

US 2021/0384655 A1 Dec. 9, 2021

(30) Foreign Application Priority Data

Jun. 8, 2020 (EP) ..... 20178758

(51) Int. Cl.
*H01R 12/67* (2011.01)
*H01R 12/81* (2011.01)

(52) U.S. Cl.
CPC ..... *H01R 12/67* (2013.01); *H01R 12/81* (2013.01)

(58) Field of Classification Search
CPC ..... H01R 12/67; H01R 12/81; H01R 29/00; H01R 12/77; H01R 12/771; H01R 12/777; H01R 12/778
See application file for complete search history.

(56) References Cited

U.S. PATENT DOCUMENTS 4,315,662 A 2/1982 Greenwood et al.
4,538,873 A * 9/1985 Worth ..... H01R 12/77 439/449

FOREIGN PATENT DOCUMENTS

DE 8013692 U1 6/1981
DE 102014208970 A1 * 11/2015 ..... H01R 12/67
WO 03/032333 A1 4/2003
WO 2010082967 A1 7/2010

OTHER PUBLICATIONS

Machine Translation of DE 102014208970 A1.*
European Extended Search Report dated Oct. 22, 2020 for European Application No. 20178758.7, eight (8) pages.

* cited by examiner

*Primary Examiner* — Oscar C Jimenez
*Assistant Examiner* — Paul D Baillargeon
(74) *Attorney, Agent, or Firm* — Greenberg Traurig, LLP

(57) ABSTRACT

Junction box for connecting a multi-wire flat cable to several terminals of a connection. The junction box comprises a support surface for a multi-wire flat cable to be contacted, and several contact blades for contacting the cable on one side without stripping the insulation. In addition, the junction box comprises several terminals, and several terminal rails adjoining the terminals, wherein each terminal rail has at least one hole, wherein a contact pin is inserted through a respective hole in a terminal rail. In each case, a contact pin is provided for a wire-to-terminal contact. The assignment of contact pins to the holes in the terminal rails defines which wire of the flat cable is connected to which terminal. An electrical contact is established between contact blades and terminal rails via one or more contact pins.

14 Claims, 31 Drawing Sheets

3LNPE-1

3LNPE-1

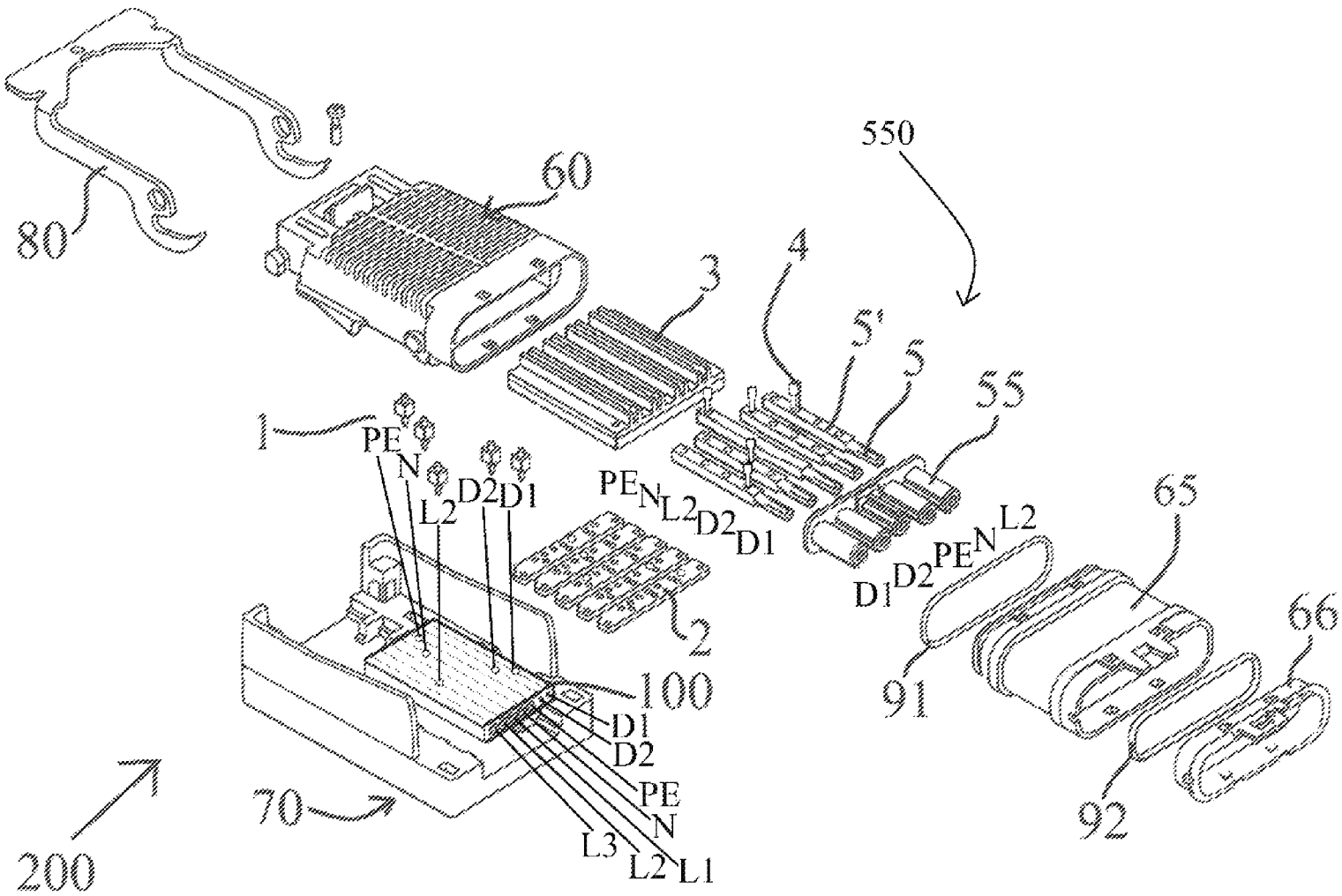
Fig. 16C L2NPE+Bus(1)

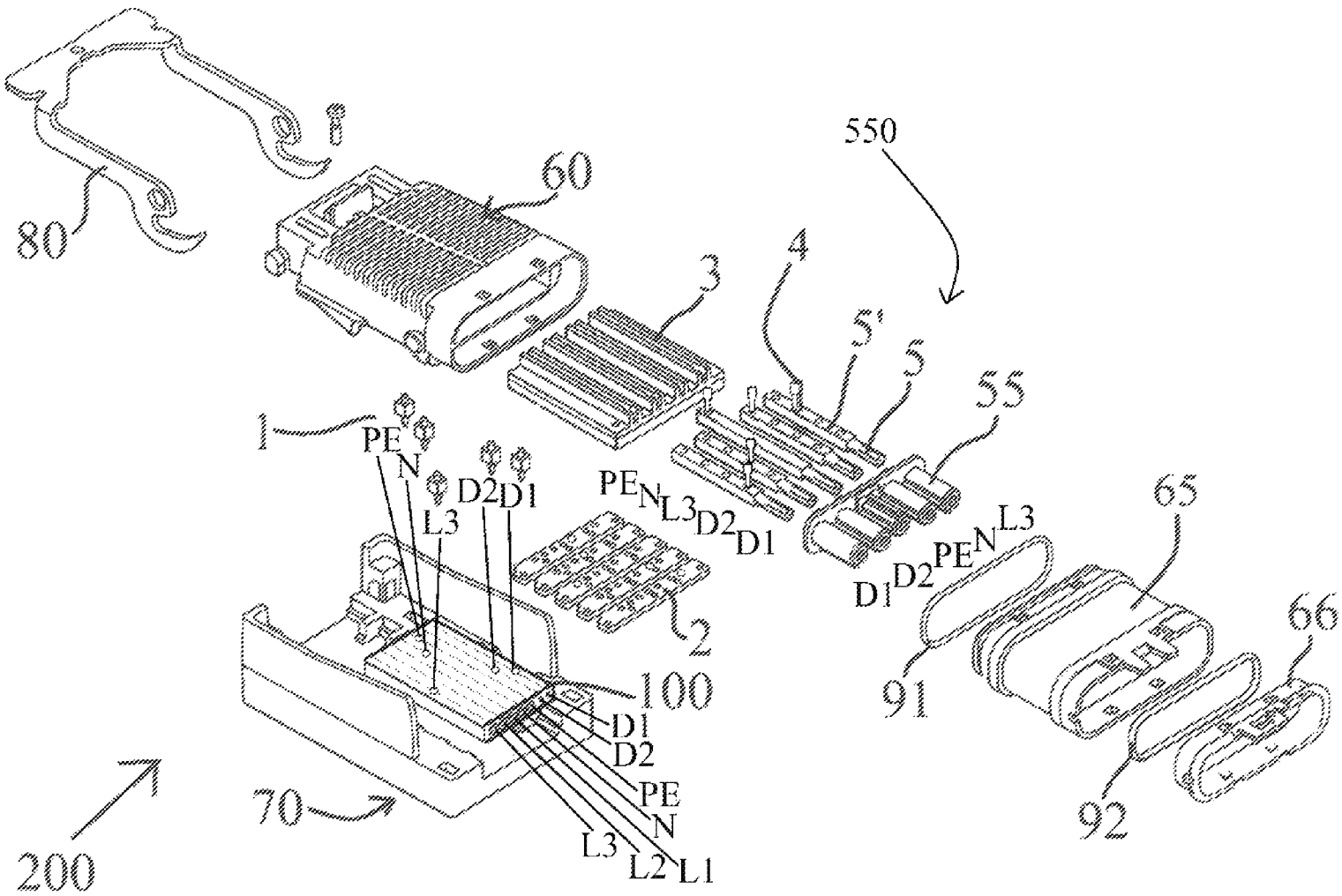
Fig. 16D L3NPE+Bus(1)

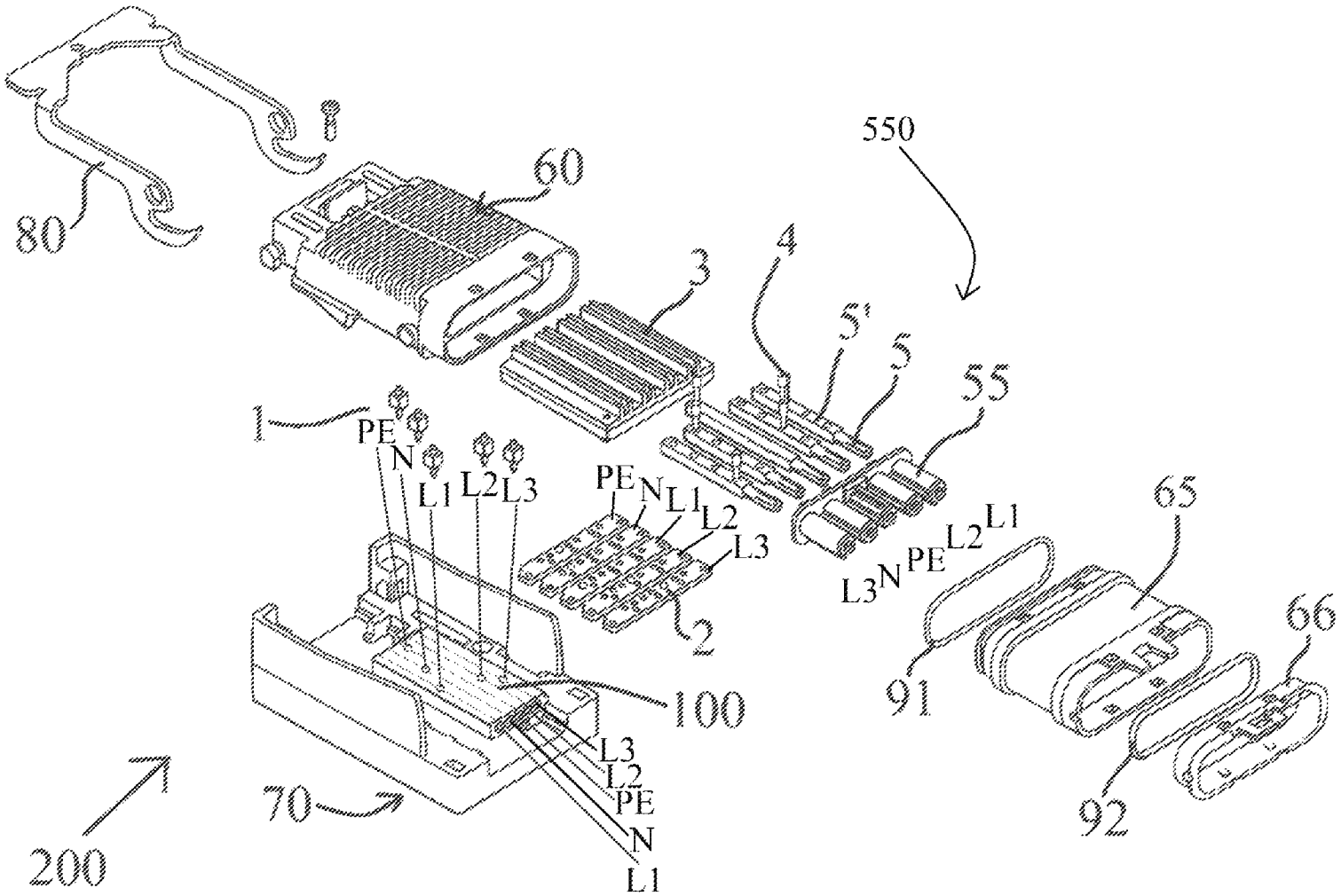
Fig. 16E 3LNPE-2

L1NPE+Bus (2)

L2NPE+Bus(2)

L3NPE+Bus(2)

JUNCTION BOX

This application claims the benefit under 35 U.S.C. § 119 of European Patent Application No. EP 20 178 758.7, filed on Jun. 8, 2020, which application is incorporated herein by reference in its entirety.

FIELD OF THE DISCLOSURE

The invention relates to a junction box for connecting any cable wires of a flat cable in any arrangement to any terminals of a connection.

BACKGROUND OF RELATED ART

DE 8013692 U1 concerns a device for preparing a mechanical and electrical connection between multi-conductor flat cables. The device described therein is used to push one or more contact pins through guide holes in a plate, which effects the correct perforations for connecting two different flat cable wires.

SUMMARY

A first aspect of the invention relates to a junction box for connecting a multi-conductor flat cable to several terminals of a connection, wherein the junction box comprises: a support surface for a multi-wire flat cable to be contacted, several contact blades for single-sided, stripping-free contacting of several wires of the flat cable, several terminals, several terminal rails adjoining the terminals, wherein each terminal rail has at least one hole, wherein a contact pin is inserted through one hole of a terminal rail in each case, a contact pin is provided in each case for a wire-to-terminal contact, the assignment of the holes in the terminal rails to the contact pins defines which wire of the flat cable is connected to which terminal, and electrical contact is made between one or more contact blades and one or more terminal rails via one or more contact pins.

A second aspect of the invention relates to an installation kit comprising: at least one through-line consisting of a flat cable, at least one connection line, and at least one junction box in accordance with the first aspect, connecting the through-line to the connection line.

BRIEF DESCRIPTION OF THE DRAWINGS

FIGS. 16A to 16H show variants of the junction box with a different arrangement of contact blades in cross-connectors together with inserted flat cable in exploded view.

DETAILED DESCRIPTION

Figure 1:
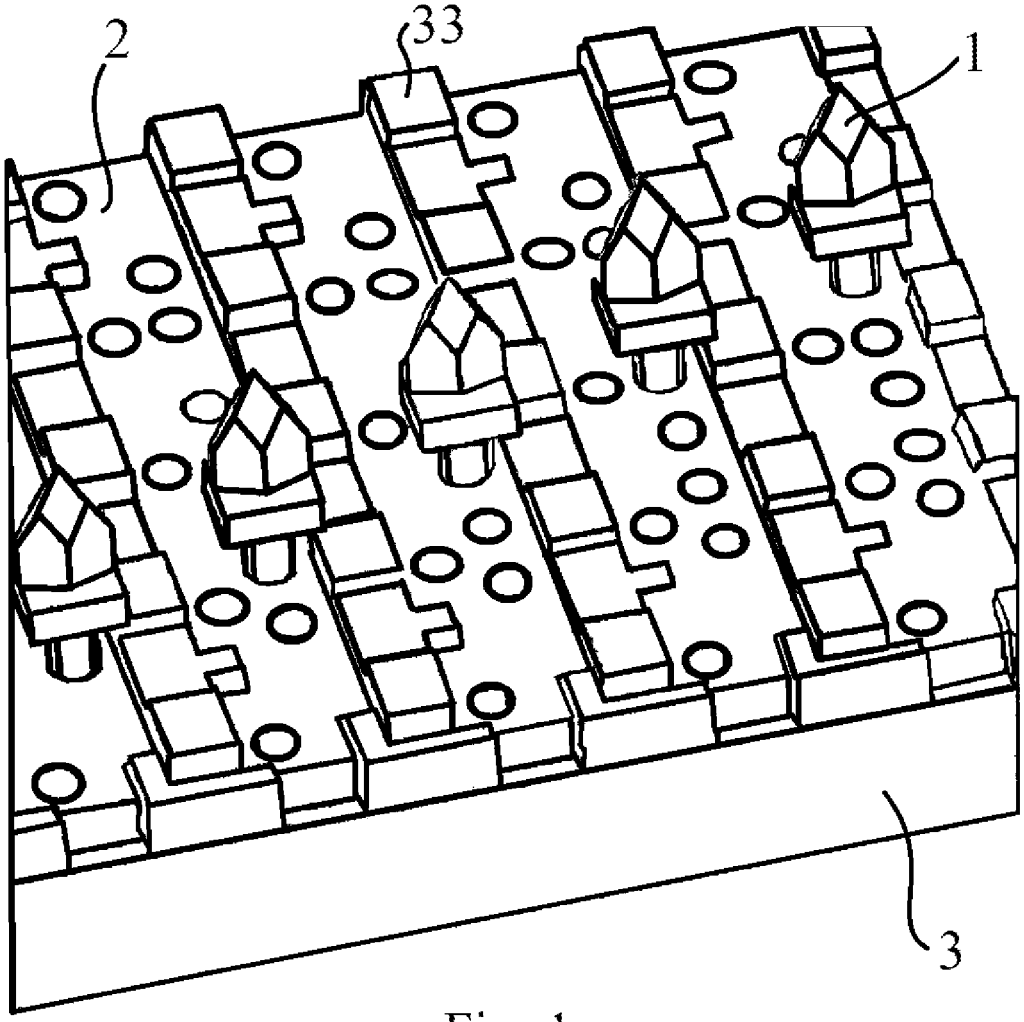
FIG. 1 is a schematic representation of the underside of a slide-in insulator with inserted cross-connectors and contact blades.

The following description of example methods and apparatus is not intended to limit the scope of the description to the precise form or forms detailed herein. Instead the following description is intended to be illustrative so that others may follow its teachings.

One aspect of the invention relates to a junction box for connecting a multi-wire flat cable to several terminals of a connection.

For example, in the flat cable and in the cable to be connected to the flat cable via the junction box, the sequence of the one to three phase conductors, the grounding conductor and the neutral conductor is different. The junction box provides the possibility for connecting wires with the same assignment, for example, the respective phase conductor(s) A(BC) of a flat cable to the same respective phase conductor(s) A(BC) of a cable coupled to the connection and the neutral conductor of the flat cable to the neutral conductor of the cable coupled to the connection as well as the grounding conductor of the flat cable to the grounding conductor of the cable coupled to the connection. The cable coupled to the connection may, for example, be a second flat cable or, alternatively, a round cable.

Similarly, the junction box creates, for example, the possibility of connecting the flat cable to a cable, wherein the sequence and assignment of data conductors are different. If, in the first flat cable, the wires are assigned with signals in the following order: Wire 1: Signal 1, Wire 2: Signal 2, Wire 3: Signal 3 etc., and in the second cable coupled to the connection the assignment: Wire 1: Signal 3, Wire 2: Signal 1, Wire 3: Signal 2 is present, then, through the junction box, the wire in the first flat cable with assignment signal 1 (here: wire 1) can be connected to the respective wire in the second cable with assignment signal 1 (here: wire 2), the wire with assignment signal 2 in the first flat cable (here: wire 2) can be connected to the wire with assignment signal 2 (here: wire 3), and so on.

Overall, the junction box is thus able to connect any wires of the flat cable to any terminals of the junction box connection.

The junction box includes a support surface for a multi-wire flat cable to be contacted, as well as several contact blades for contacting several wires of the flat cable on one side without stripping.

The junction box comprises, for example, an inlet for the flat cable and can also comprise an outlet for this flat cable, so that the flat cable can be guided through the junction box. However, the junction box may also include only one entry for the flat cable, so that the flat cable terminates in the junction box. The support surface for the flat cable is adapted to the surface contour of the flat cable, for example.

The contact blades pierce the sheath of the flat cable resting on this contact surface, for example, by being driven through the sheath into the respective cable wires in the direction of the contact surface. One contact blade is typically provided for contacting one wire of the flat cable.

The junction box also includes several terminals for one connection. The connection here can be a socket or a plug, corresponding to connections for cables that are to be connected to the flat cable tapped via the junction box. The terminals of this connection typically have a shape such that, for example, a round cable or flat cable can be coupled to the connector.

Terminal rails connect to the terminals. Terminals acting as connectors are manufactured in one piece with the terminal rails—terminals and terminal rails connected to them are a single component. The terminal rails are typically located inside the junction box, which protects them from dust and moisture. The terminals are also protected from dust and moisture, for example, by being enclosed in a socket attachment/plug attachment for the second flat cable. The entire junction box is designed, for example, to be waterproof and/or dustproof to class IP20, IP40 or IP65 or IP68.

Each of the terminal rails has at least one hole, wherein a contact pin is inserted through a hole in a terminal rail. The holes in the terminal rails are drilled, for example, perpendicular to the direction in which the terminal rails extend inside the junction box. For example, the holes in a terminal rail are arranged in succession in the terminal rail. A contact pin can be inserted through each of hole in this row of holes.

A contact pin is provided for each wire-to-terminal contact. If a connection is to have five terminals, for example, the terminal rail belonging to the terminal has five holes arranged in succession; for a possible connection to two different wires of the flat cable, there would correspondingly be only two holes arranged in succession.

The assignment of contact pins to the holes of the terminal rails defines which wire of the flat cable to be contacted or tapped is connected to which terminal. If, for example, a terminal belongs to a terminal rail with five holes arranged in succession, positioning the contact pin in one of these holes defines to which wire of the flat cable an electrical connection is made. An electrical contact is thus established between the contact blades and the terminal rail via the contact pins. A hole to accommodate a contact pin in the terminal rail represents such a possible connection.

The junction box can be constructed in such a way that positioning of the contact pins in the holes of the terminal rails is fixed, that is to say, certain wires of the flat cable are firmly connected to certain terminals by the junction box.

However, the box can also be manufactured in such a way that, by pulling out a part of the junction box which carries the terminal elements, such as a slide-in unit with a slide-in insulator, for example, the contact pins become accessible and the positioning of the contact pins in the holes of the terminal rails can be changed so that other cable wires of the flat cable can in each case be connected to the respective terminals.

In some embodiments, the junction box includes cross-connectors. Cross-connectors establish the electrical connection between the contact pins and contact blades. Cross-connectors are typically made of metal.

Cross-connectors are typically arranged at right angles to the course of the cable wires in the flat cable to be contacted or tapped in the junction box and thus extend across all cable wires of this flat cable. The holes in the first row of holes are arranged, for example, so that a contact blade is placed exactly above a cable wire to be contacted—the distances between the holes in the first row of holes thus correspond to the distances between the wires in the flat cable to be contacted.

In this embodiment, for example, the cross-connectors include a row with several first holes. The positioning of the contact blades in the corresponding holes determines which cross-connector is connected to which contact blade and thus to which cable wire of the flat cable. The positioning of the contact blade pressed into a hole in the cross-connector (that is to say, the choice of the hole on the cross-connector) determines which wire of the flat cable is contacted by the contact blade when the cross-connector together with the contact blade is pressed against the upper side (that is to say, unsupported side) of the flat cable fed into the junction box. Thus, by changing this positioning, it is possible to freely select which cross-connector is connected to which wire of the flat cable.

Alternatively, in some embodiments, the contact blade and the cross-connector may be permanently connected to each other or designed as a single piece, so that it is permanently established which cross-connector is connected to which cable wire by means of the contact blade.

In some embodiments, the cross-connectors include a row with several second holes that receive the contact pins extending from the terminal rails. A contact pin is thus inserted, for example, with one end in a hole in a terminal rail and the other end in a hole in a cross-connector and thus electrically connects the terminal rail and the cross-connector to each other.

In some embodiments, each terminal rail includes a row with several holes arranged in series, wherein contact pins extend from a hole in a terminal rail to a hole in a cross-connector to make the electrical connection from a particular terminal rail to a particular cross-connector. This results in an electrical connection between the terminal belonging to the terminal rail and the cable wire tapped by the contact blade of the cross-connector, as described above.

In some embodiments, the junction box includes a slide-in insulator positioned between the cross-connectors and the terminal rails. The slide-in insulator serves the purpose of electrically insulating the cross-connectors and the terminal rails or terminals from each other regardless of their intended electrical connection via the contact pins. This prevents short circuits between two or more wires of the flat cable via the cross-connectors or terminals. The slide-in insulator is made of plastic, for example.

In some embodiments, the cross-connectors are attached to the side of the slide-in insulator that faces the support surface for the flat cable to be contacted or tapped, and the terminal rails are attached to the opposite side of the slide-in insulator. The cross-connectors are clamped, for example, in recesses arranged in succession in rows on the underside of the slide-in insulator, while the terminal rails are clamped in recesses likewise arranged in succession in rows on the top of the slide-in insulator. In this example, the underside of the slide-in insulator is understood to be the side in the junction box opposite the contact surface for the flat cable to be contacted or tapped.

In some embodiments, the slide-in insulator is provided with holes only at positions where contact pins are inserted through the insulator from the terminal elements to the cross-connectors. The positioning of the contact pins in the holes of the terminal connectors and the holes of the cross-connectors is specified by this hole coding on the slide-in insulator.

The hole coding thus determines which wires of the flat cable to be contacted or tapped are connected to which terminal by the push-through contact pins. Since the slide-in insulator has holes only at these intended connection points, a contact pin can only be inserted at these points, through a hole in the terminal rail belonging to the terminal, through the hole in the slide-in insulator into a hole in the intended cross-connector. This prevents the terminal from being connected to an incorrect cross-connector and thus to an incorrect cable wire of the flat cable due to an incorrectly inserted contact pin.

In this embodiment, the contact pins are inserted individually from the holes in the terminal rail through the holes in the slide-in insulator to the holes in the cross-connectors.

In other embodiments, the slide-in insulator is also provided with a hole for each hole in a terminal rail, so that the connection of a terminal to a cable wire can still be freely selected.

In some embodiments, the slide-in insulator has contact pins permanently inserted at certain positions that establish an electrical connection between certain terminal rails and certain cross-connectors.

In this embodiment, there is no need to insert each contact pin individually through the holes in a terminal rail/insulator/cross-connector—for example, the contact pins protrude from both sides of the slide-in insulator at the points required to establish an electrical connection between the cross-connector and the terminal rail. The terminal rails and cross-connectors are then inserted, for example, into receptacles on the two sides of the insulating body in such a way that they receive the upper and lower ends, respectively, in the corresponding holes or bores of the terminal rails or cross-connectors.

In this embodiment, it is also impossible for an incorrect connection to occur due to the incorrect insertion of a contact pin. However, the freedom to connect any cable wires to any terminals is also eliminated here, since the position of the contact pins in the holes of the terminal rails cannot be changed.

In some embodiments, as noted above, the junction box is adapted to connect a flat cable having five wires to five particular terminals of the connection. For example, three of the wires in the tapped flat cable are phase conductors, one wire is a neutral conductor, for example, and another wire is a grounding conductor, for example. An example of this would be connecting a first five-wire flat cable to a second flat cable via the junction box, wherein the assignments of the cable wires in the first flat cable and the second flat cable are different.

Accordingly, five contact blades, five cross-connectors, five terminal rails and associated terminals, and five contact pins are provided to connect corresponding phase conductors, neutral conductors, and grounding conductors of the flat cable to the terminals for the corresponding phase conductors, neutral conductors, and grounding conductors of any cable to be connected to the junction box or, in the above example, the second flat cable.

In this embodiment, for example, the cross-connectors have five holes to receive five contact pins, which are inserted respectively through five holes in the terminal rails arranged in succession, through five holes of the slide-in insulator, and terminate in the holes of the cross-connectors (here, for example, in the second row of holes in the cross-connectors).

Similarly, in one embodiment, although a five-wire first flat cable is tapped by means of five cross-connectors and inserted contact blades, only three terminals and associated terminal rails with holes are provided, so that a connection from a five-wire flat cable to three terminals of the connection may be made by means of the junction box. For example, a connection can be made from the first flat cable to a second three-wire flat cable that is coupled to the connector, or likewise a connection can be made from a three-wire flat cable to a three-wire round cable.

In some embodiments, the junction box is adapted to connect two data conductors of the flat cables in addition to the five conductors of the first and second flat cables, wherein corresponding contact blades, cross-connectors, terminal connectors, and contact pins are provided to transfer the corresponding data conductors of the first flat cable to the corresponding terminals for the data conductors of the second flat cable.

For example, the junction box can be designed so that it can be used to establish a connection between a KNX standard line and a DALI® lighting control system. Here the input can be a KNX system (first flat cable optionally with data conductors) and the output a DALI® system (second flat cable optionally with data conductors) or vice versa. However, DALI® should only be used here as an example of any general bus system; connections to other bus systems are conceivable and possible.

If a certain data signal on data conductor wires of the terminals, for example, is to be decoupled to a second (flat) cable, which does not correspond to the data signal that is transported on the tapped flat cable, then an electronic converter may be present inside the junction box. The electronic converter converts the data signals supplied by the tapped flat cable into the data signals to be applied to the terminals. The converter can be arranged in an intermediate level of the junction box and receive signals from contact blades or cross-connectors at an input, while it delivers the signals already converted to the specific format at an output to the contact pins connected to the terminals or, for example, delivers them directly to the terminals via the terminal rails.

In some embodiments, the contact pins are permanently anchored in an electrically insulating pin plate such that the arrangement of the contact pins corresponds to the desired connection of wires in the flat cable to the terminals, and electrical contact between the contact blades and the terminal rails is made by pressing the pin plate against the terminal rails, wherein that pressure drives the contact pins through the holes in the terminal rail and into the holes in the cross-connectors.

In this embodiment, for example, a slide-in insulator is also provided between the cross-connectors and the terminal rails to electrically isolate them from each other except for contact via the contact pins. In this embodiment, by pressing the insulated pin plate with a jolt, the contact pins are pressed directly through the holes in the terminal rails, insulator body, and cross-connectors to connect the terminals to the desired wires in the flat cable. The coding of the contact pins to establish this connection is thus directly determined by the arrangement of the contact pins on the pin plate. For example, the contact pins protrude from the insulated pin plate on one side.

This design with an insulated pin plate allows quick connection of the wires in the flat cable with the corresponding terminals of the connection. However, more force may be required to make this connection than if the contact pins are individually inserted through the holes in the terminal rails, insulator, and cross-connector. In order to provide this additional force, the junction box can have a lever element by means of which, for example, the insulating pin plate can be pressed in the direction of the terminal rails and at the same time the entire slide-in unit together with the contact blades projecting in the direction of the flat cable can be pressed against the flat cable to be contacted or tapped.

If such an insulating pin plate is used, the arrangement of the contact pins on it is predetermined and cannot be adapted as desired.

In some embodiments, the terminals are part of a connection as mentioned above, which is a connection for a round cable or for a flat cable. This round or flat cable can serve as a connecting cable, that is to say, it can be fed via the flat cable tapped from the junction box or can feed that flat cable. However, the round or flat cable coupled to the connection can also serve as a feed line itself and feed the flat cable tapped from the junction box. Accordingly, the connection can be designed as a plug insert or also as a socket insert. If the terminals are part of a connector system, the terminals in this case are designed as connector pins.

In some embodiments, the clamps are arranged at right angles to the flat cable resting on the support surface so that a connection can be made between two flat cables arranged perpendicularly to each other. In this case, the terminal rails also extend at right angles to the direction in which the flat cable extends. In this embodiment, the contact pins can be directly connected to the contact blades or manufactured as part of them.

Since the terminal rails are arranged with their holes facing each other perpendicularly to the cable wires of the flat cable, each contact rail can be electrically connected to any wire of the flat cable via one of the holes. Tapping can, as mentioned above, be done via separate contact blades, which are then electrically connected to the contact pins, or the contact pins can have a contact blade at their ends that passes through the holes in the terminal rails, so that a contact blade and adjoining contact pin form one component.

In some embodiments, the clamps are arranged parallel to the flat cable resting on the support surface, whereby a connection is created between two flat cables arranged parallel one above the other. In this embodiment, the terminal rails adjoining the terminals run, for example, parallel to the wires in the flat cable resting on the support surface and above that flat cable resting on the support surface.

In some embodiments, the junction box is constructed in multiple parts, wherein a first part comprises a sleeve, wherein a slide-in unit comprising the slide-in insulator, the terminal rails with inserted contact pins, and the cross-connectors with inserted contact blades is inserted into the sleeve, so that the contact blades protrude from the sleeve on its side facing the contact surface for the flat cable to be contacted or tapped.

The slide-in unit consists, for example, of a slide-in insulator which has holes for the contact pins to pass through and on one side of which the terminal rails are inserted and on the other side of which the cross-connectors are inserted in the transverse direction to the terminal rails. For example, as mentioned above, the cross-connectors are provided with contact blades placed in a series of first holes. For example, the cross-connectors also have a second row of holes that are designed to receive the contact pins. The contact pins are inserted through the holes in the terminal rail and the holes in the slide-in insulator and end in the holes in the second row of holes in the cross-connectors. The terminals adjoining the terminal rails are enclosed by a socket or plug attachment, for example. This socket or plug attachment can be enclosed by a sealing sleeve together with O-rings to additionally protect the terminals from the penetration of dust or water. The sleeve, which for example forms part of the first part of the junction box, can also be designed as a sealing sleeve with possibly further sealing attachments that provide protection against the entrance of dust or water. For example, class IP68 protection can thereby be achieved. The contact pins can be provided with their own seal in arrangements that provide protection against the entrance of dust or water in accordance with IP68.

In these embodiments, a second part comprises the support surface for the flat cable to be contacted or tapped and a receptacle for the first part with side walls in which the sleeve of the first part is inserted for contacting the flat cable.

The support surface for the flat cable can be located in a recess of this second part of the junction box. Support surfaces for the sleeve of the first part can be provided on the edges of this recess. These support surfaces of the first part are bordered by side walls which, together with the support surfaces for the sleeve, form a receptacle for the sleeve. The contact blades inserted into the side of the sleeve facing the contact surface protrude into the recess which forms the contact surface for the flat cable. If a flat cable to be contacted is inserted into the recess, these contact blades are placed over the individual wires in the flat cable.

For example, the support surface for the first flat cable is designed or coded to conform to the contour of the flat cable. This prevents a wrong cable from being inserted or a cable from being inserted the wrong way around.

Likewise, the underside of the first part of the junction box can be equipped with coding in addition to openings for the contact blades so that the flat cable can likewise not be inserted twisted, that is to say, with the wrong orientation, or likewise only a suitable type of flat cable can be inserted.

In these embodiments, a lever element is also provided to press the sleeve together with the protruding contact blades in the direction of the contact surface for the flat cable in order to contact the flat cable. On the first part, in particular on its sleeve, or on the second part, in particular on its side walls, anchor points for the lever can be provided, around which the lever can be moved to press the first and second parts of the junction box against each other, thus pressing the sleeve together with the contact blades protruding therefrom in the direction of the support surface for the flat cable.

Another aspect relates to an electrical installation kit. The installation kit comprises at least one through-line consisting of a flat cable, at least one connection line formed by a flat cable, and at least one junction box in accordance with the first aspect connecting the through-line to the connection line.

Referring now to the drawings, the underside of an insulating body 3, also referred to as a slide-in insulator 3, together with cross-connectors 2 inserted therein is shown in FIG. 1. The underside is generally referred to here as the side of the slide-in insulator 3 which, in the installed state of the junction box 200 (see FIGS. 14, 15, 16, 19A, 19B) is pressed against the flat cable 100 (see, for example, FIGS. 7, 14, 16, 19A, 19B) to contact it.

The slide-in insulator 3 has receptacles 33 for the cross-connectors 2 on its underside. In the example shown in FIG. 1, these are five receptacles for five cross-connectors 2. A contact blade 1 is inserted into each of the five cross-connectors 2 so that it protrudes from the underside of the slide-in insulator 3, as well as from the cross-connectors. Each contact blade is inserted, for example, with its pin-shaped blunt end in a hole 20 (see, for example, FIG. 2) of the respective cross-connector 2. The contact blades are arranged along a diagonal on the underside of the cross-connector 2, so that when this side is pressed against a flat cable, each contact blade 1 contacts a different wire of the flat cable 150 (see, for example, FIG. 7).

Figure 2:
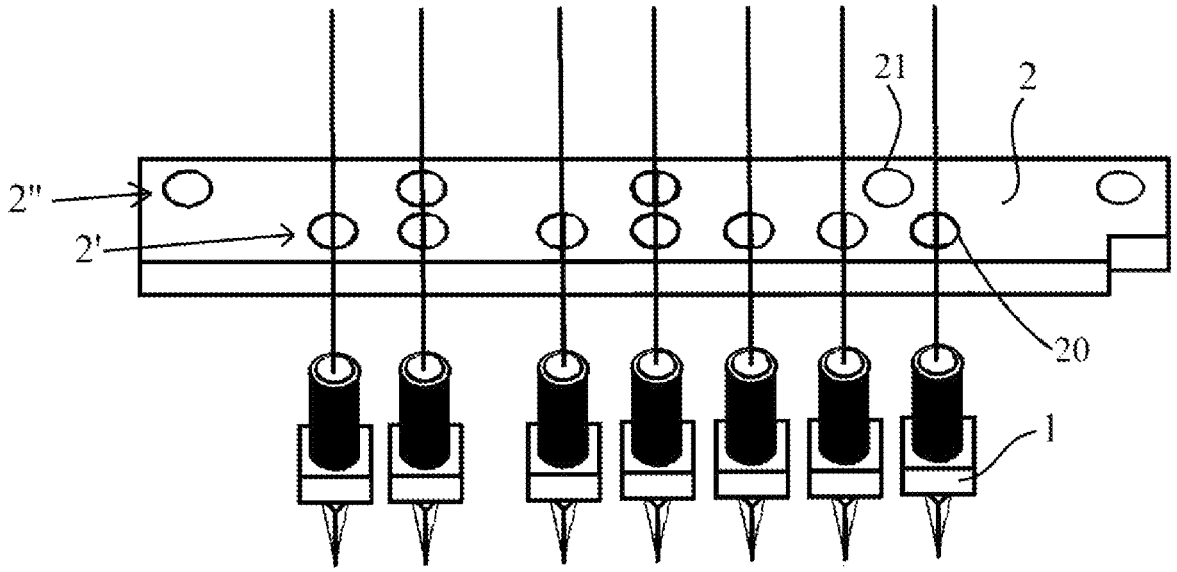
FIG. 2 is a schematic illustration of a single cross-connector with a row of holes for receiving contact blades.

A cross-connector 2 is shown schematically in FIG. 2 together with the contact blades to be inserted in it. For example, the cross-connector 2 has two rows of holes 2', 2". The first row of holes 2' has seven holes 20 arranged in a row along the longer side of the crossmember. The cross-connector 2 is made of metal, for example, and takes the form of a perforated plate.

Seven contact blades 1 are shown as an example in FIG. 2, each of which can be inserted into one of the seven holes in the first row of holes 2' of the cross-connector 2. The hole through which the contact blade is inserted determines which wire of the flat cable 100 to be contacted (see, for example, FIG. 7) is contacted.

Figure 7:
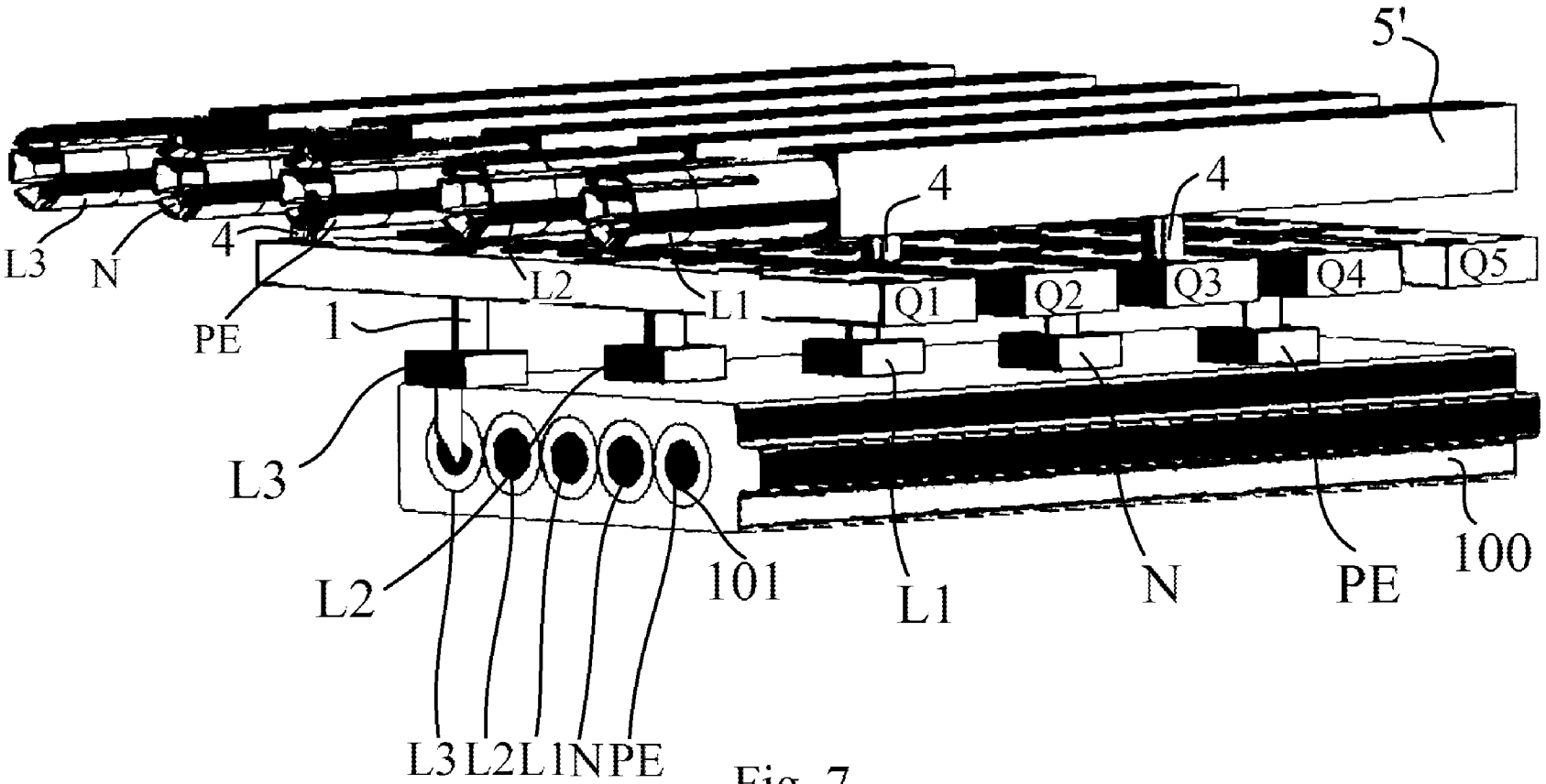
FIG. 7 is a schematic view of schematic tapping of a flat cable and connection of individual wires to terminals by means of contact blades, cross-connectors and contact pins.

Precautions can be taken to ensure that the grounding conductor wire PE (see, for example, FIG. 7) of a flat cable 100 (see, for example, FIG. 7) always makes contact first when the contact blades 1 are pressed into the flat cable 100 (see, for example, FIG. 7). This can be ensured, for example, by making the contact blade 1 intended for the PE wire slightly longer than the other contact blades 1.

The seven holes arranged in a row in the first row of holes 2' shown here as examples are divided into a group of five and a group of two. When a contact blade 1 is placed in a hole 20 of the group of two, a wire D1 or D2 with a data signal (see FIG. 14) in the flat cable 100 (see, for example, FIGS. 7, 14, 16, 19A, 19B) can be tapped. If a contact blade 1 is placed in a hole 20 of the group of five, phase conductor wires L1, L2, L3 or a neutral conductor wire N, or a grounding wire PE (see, for example, FIG. 14) can be tapped. The contact blades 1, which are metal for example, create an electrical connection between the cable wires L1, L2, L3, N, PE, D1 or D2 and the cross-connector 2, so that current or an electrical data signal is applied to the cross-connector 2.

Directly behind the first row of holes 2', for example, is a row of second holes 2" comprising five holes 21 arranged side by side. The holes 21 in the second row of holes 2" are intended to receive contact pins 4 (see, for example, FIG. 3).

Figure 3:
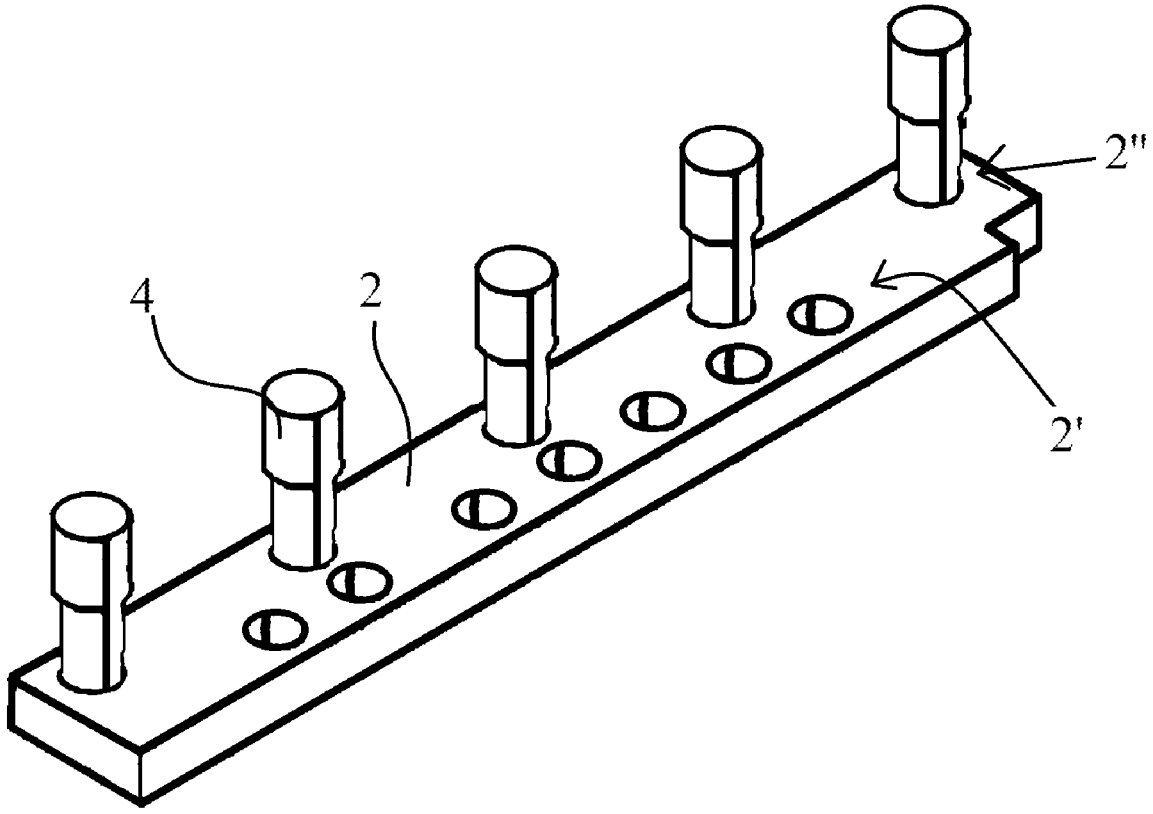
FIG. 3 is a schematic representation of the single cross-connector from FIG. 2 with a row of holes for contact pins.

The contact pins 4 inserted into the holes 21 of the second row of holes 2" in the cross-connector 2 from FIG. 2 are shown in FIG. 3. The second row of holes 2" comprises five holes, each of which can accommodate a contact pin 4. Via these holes, depending on which hole of the second row of holes 2" actually receives a contact pin, the cross-connector 2 can be connected to five different terminal rails with holes. These terminal rails 5' are integrally connected with terminals (terminal 5 and terminal rail 5' are a single component (see, for example, FIG. 4). A contact pin 4 can be used to apply current to a specific terminal 5 via a specific terminal rail 5'.

Figure 4:
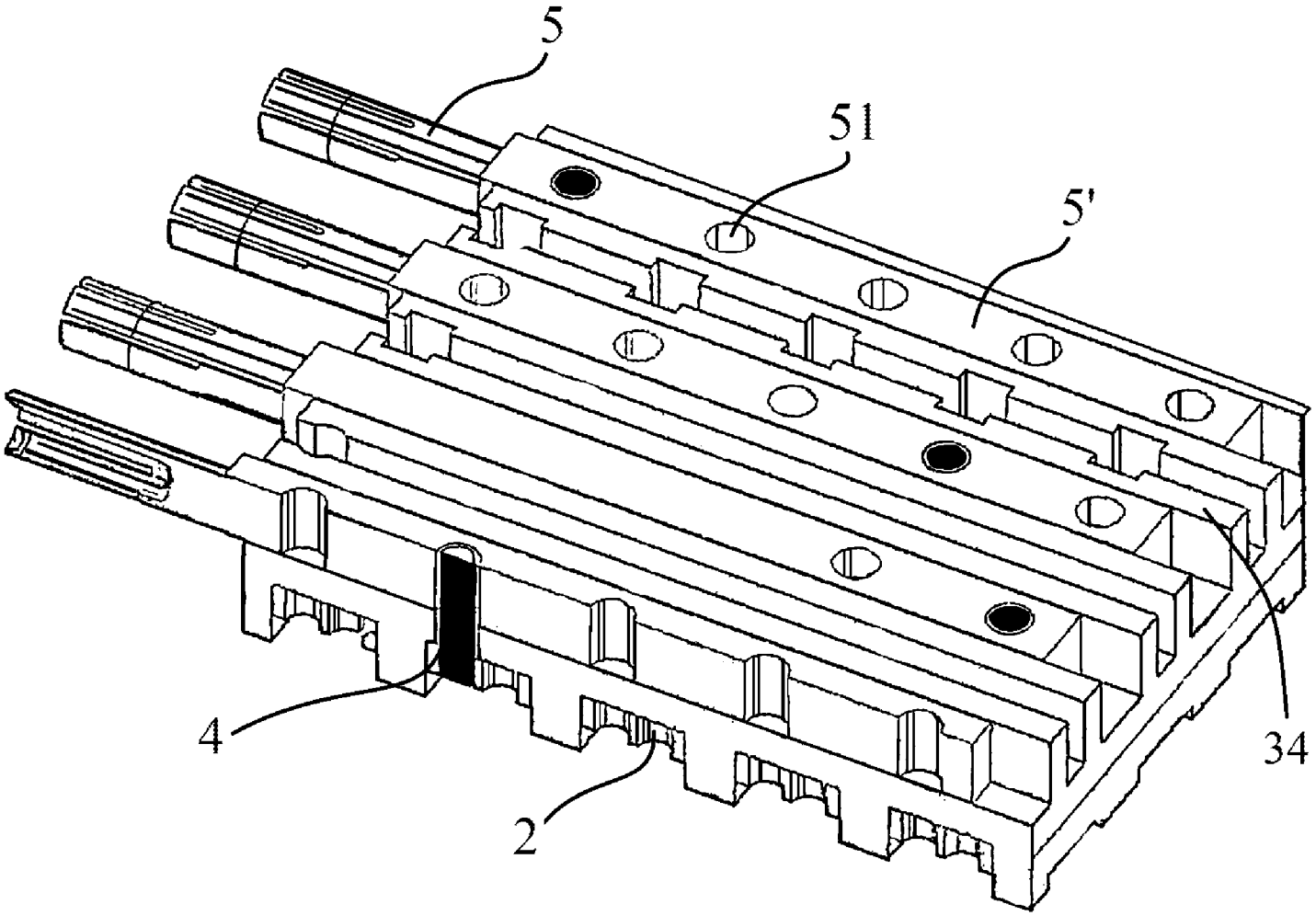
FIG. 4 is a schematic diagram of a slide-in insulator with cross-connectors attached to its underside (FIGS. 2, 3) and terminal rails attached to its upper side, wherein the terminal rails are electrically connected to the cross-connectors through the insulating body by means of contact pins.

A slide-in insulator 3 with cross-connectors 2 attached to its underside (see FIGS. 2, 3) and terminal rails attached to its upper side is shown in a schematic sectional view in FIG. 4. The underside of the arrangement shown in FIG. 4 may be configured as shown in FIG. 1—each of the cross-connectors has a contact blade 1 inserted in a different hole of the first row of holes (see FIG. 1) to allow a different wire in the flat cable 100 (see FIGS. 7, 14, 16, 19A, 19B) to make contact. The slide-in insulator 3 is typically made of an insulating material such as plastic.

The terminal rails 5' are electrically connected to the cross-connectors 2 through the insulating body by means of contact pins 4. To enable this connection, each of the terminal rails 5' has at least two holes 51 arranged in succession. The contact pins 4 are inserted through these holes 51 and through holes 31 in the slide-in insulator 3 (see FIG. 5) up to a hole in the second row of holes in the cross-connector 2. Assigning a contact pin to a specific hole 51 of a terminal rail 5' determines the cross-connector 2 to which the terminal rail 5' is electrically connected. This allows current or signal to be applied from any cross-connector 2 to a specific terminal rail 5'.

Figure 21:
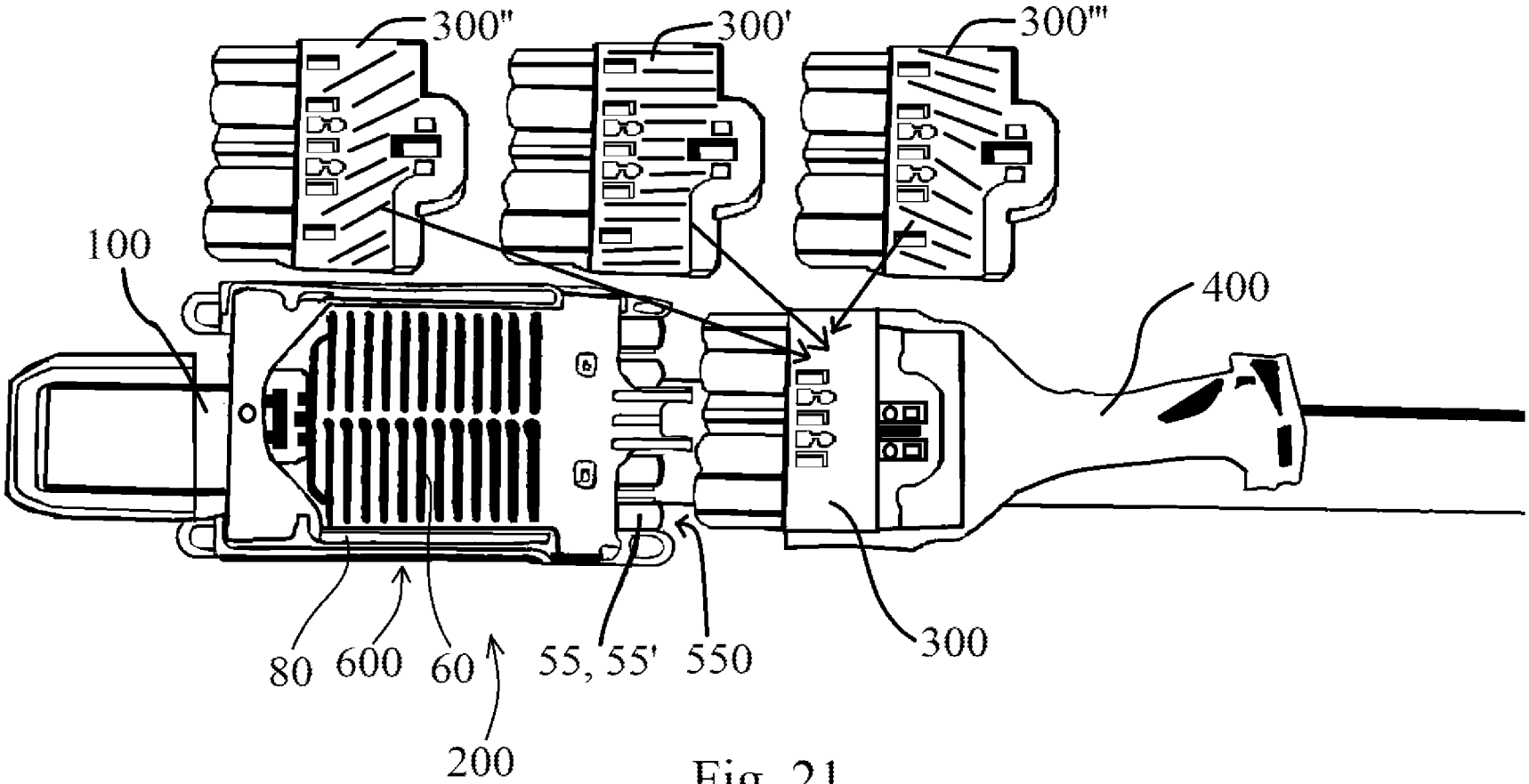
FIG. 21 is an example of a junction box which additionally comprises a plug for a round cable, wherein in the illustration the plug is separated from the connection of the junction box.
Figure 22:
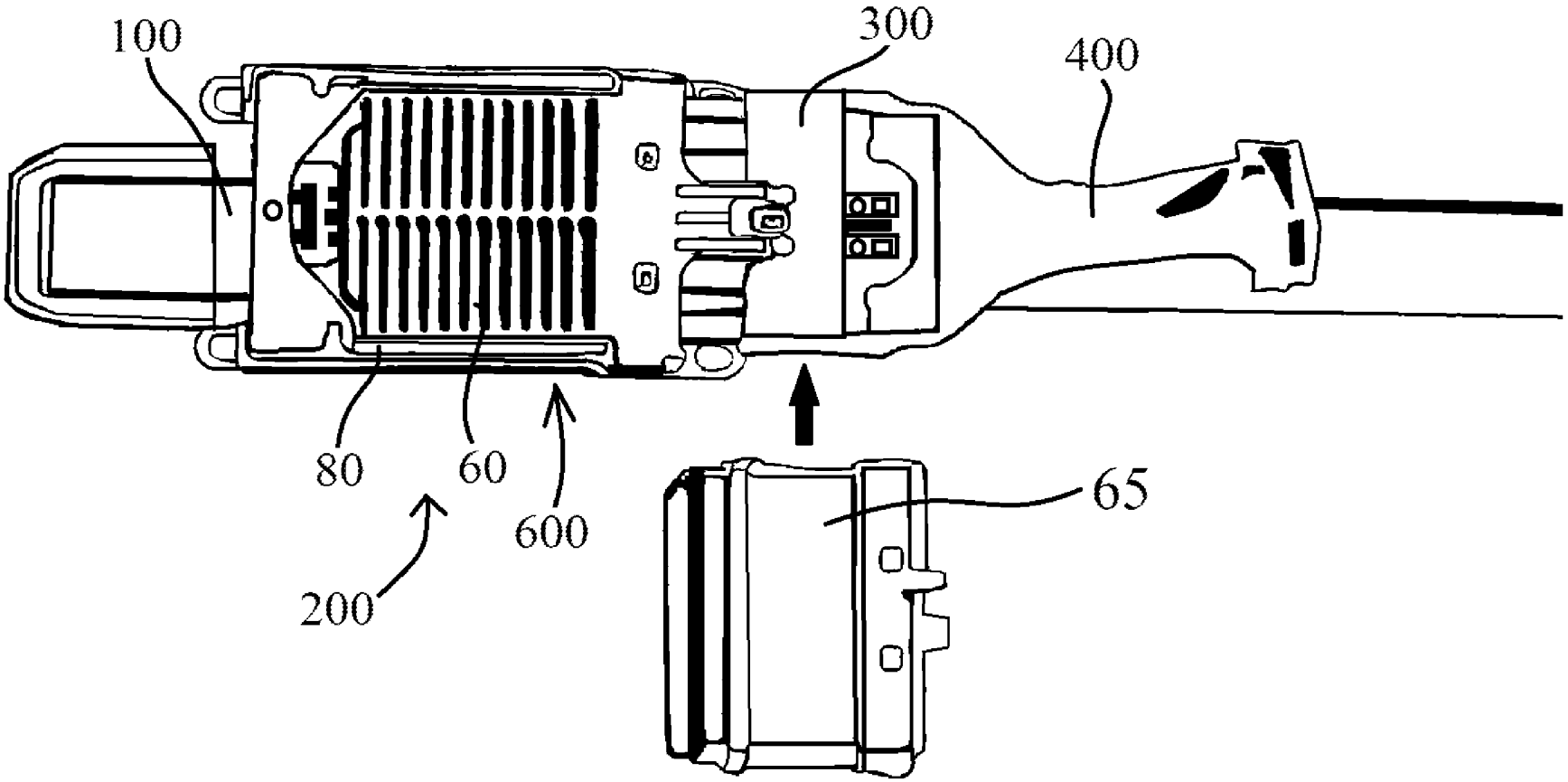
FIG. 22 shows the junction box of FIG. 21, with the plug inserted into the connection.

The terminals 5 are connected to the terminal rails 5' in one piece, as shown in FIG. 4. The terminals 5 are suitable, for example, to be connected to the wires of a second flat cable 150 (see FIGS. 19A, 19B). As mentioned, the terminals 5 can also be part of a connection 550 (see FIGS. 14A-C, FIG. 16, 16A-H; FIG. 21, FIG. 22), to which a round cable is connected (see FIG. 21, FIG. 22). As already mentioned in the general explanations of the invention, the terminals 5' can also be part of a connector system, wherein the terminals 5' would be designed as connector pins.

Here, the position of the contact pins 4 in the terminal rails 5' determines which wire of the flat cable 100 to be contacted or tapped is connected to which terminal 5. In embodiments in which the connection 550 (see FIGS. 14A-C, FIG. 21) is coupled to a flat cable, it is thus determined to which wire of the second flat cable 150 (FIGS. 19A, 19B) a cross-connector 2 and, depending on the position of the contact blades in the cross-connector 2, a specific cable wire of the flat cable 100, is connected.

Figure 5:
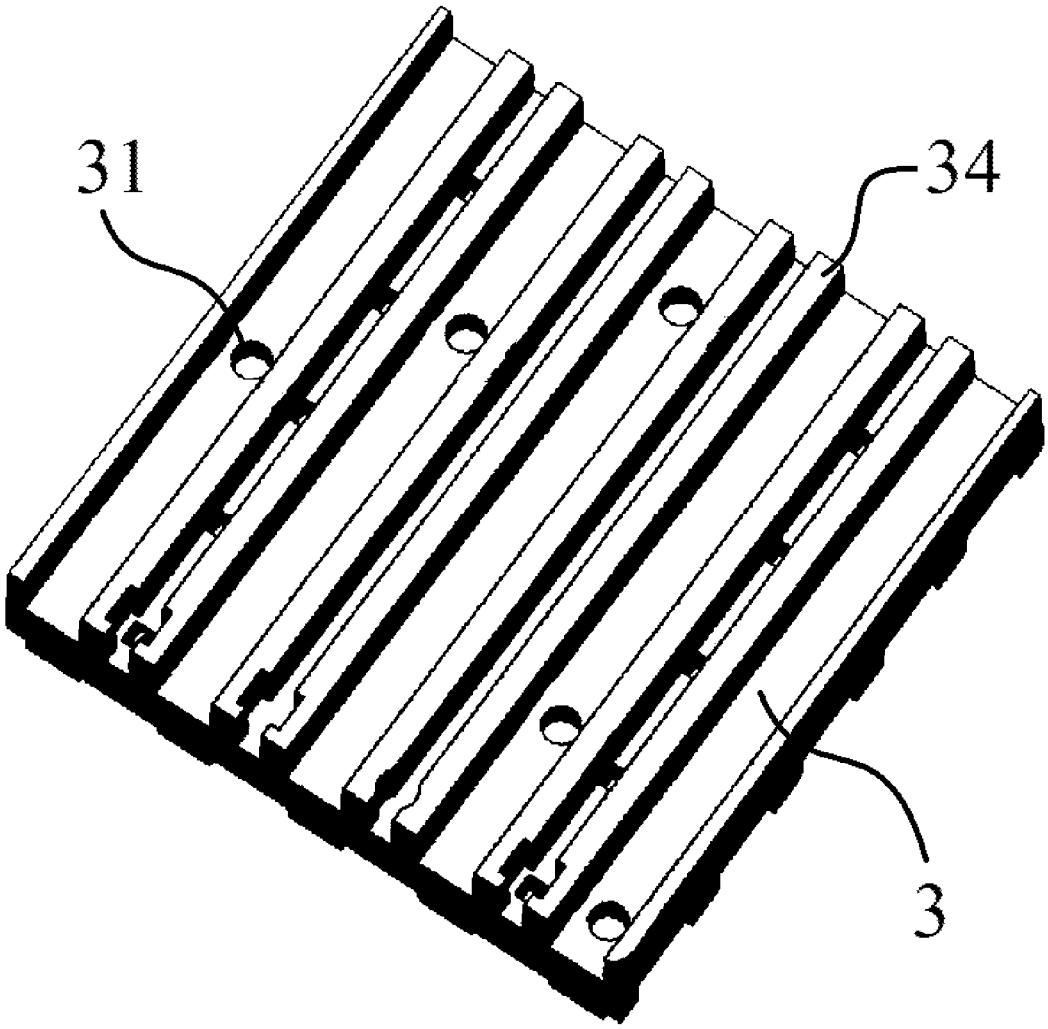
FIG. 5 is a schematic front view of a slide-in insulator as in FIG. 1 and FIG. 4 with holes that provide a coding for contact pins to be inserted.

A top view of the slide-in insulator 3 with the receptacles 34 for the terminal rails 5' (see, for example, FIG. 4) is shown in FIG. 5. The slide-in insulator 3 has several (here: five) holes 31, which are arranged in the receptacles for the terminal rails 5'. These holes 31 provide coding indicating through which holes contact pins 4 can be inserted in the terminal rails 5' in the direction of the holes in the cross-connectors 2 (see, for example, FIGS. 1 to 4). This prevents assembly errors, that is to say, connections of the wrong cross-connectors to a terminal and thus the wrong cable wire of the flat cable 100 (see FIGS. 7, 14, 16, 19A, 19B) to a terminal 5.

Figure 6:
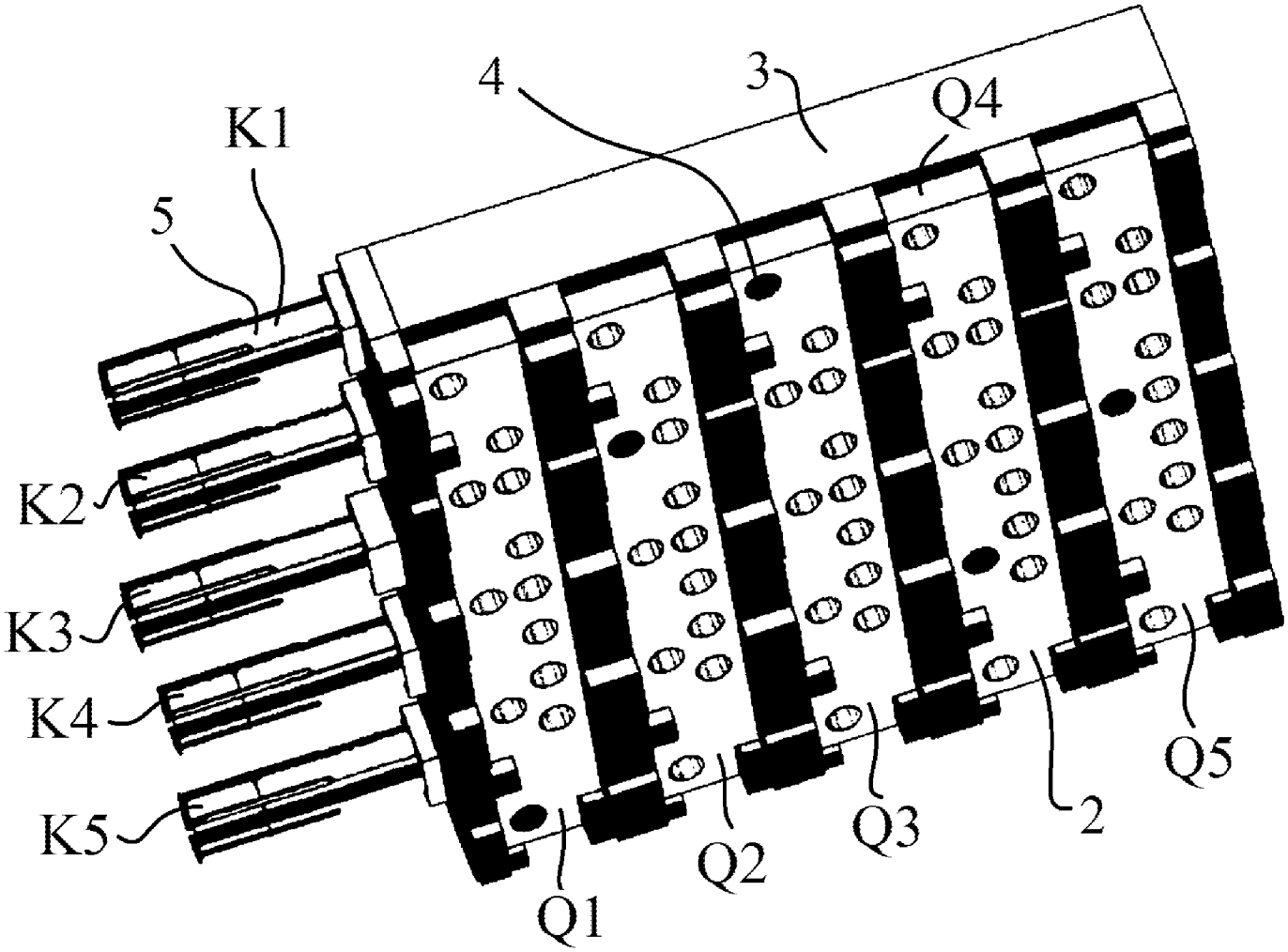
FIG. 6 is a schematic view of the underside of the slide-in insulator shown in FIG. 4 with terminal rails and cross-connectors received therein, without contact blades inserted therein.

The slide-in insulator 3 from FIG. 4, with the terminal rails 5' accommodated on its upper side and the cross-connectors 2 accommodated on its lower side, is shown in FIG. 6 together with the contact pins 4 inserted through it in a view of its lower side. It can be seen in one view that the cross-connectors 2 are arranged in slide-in units in succession along the direction in which the terminal rails 5' extend (see FIG. 4). In the example shown here, five cross-connectors are electrically connected by the contact pins 4 to five different terminals 5.

In the example given by FIG. 4 and FIG. 6, terminal K1 is connected to cross-connector Q3, terminal K2 is connected to cross-connector Q2, terminal K3 is connected to cross-connector Q5, terminal K4 is connected to cross-connector Q4, and terminal K5 is connected to cross-connector Q1.

A schematic view of a schematic tap of a flat cable and connection of individual wires to terminals by means of contact blades, cross-connectors and contact pins is provided in FIG. 7. In this schematic view, the arrangement from FIG. 7 does not have a slide-in insulator 3 (see, for example, FIGS. 4 and 6); the parts may be insulated from each other by air in this arrangement. However, a slide-in insulator 3 may also be present here.

A contact blade 1 contacts or taps the cable wire L3 of the flat cable 100 without stripping. The current of this phase wire L3 is applied to the terminal rail of terminal L3 via the cross-connector Q1 and a contact pin 4 inserted into it, which opens into the terminal rail of terminal K1. In accordance with the same principle, the current of the phase conductor L2 is connected to the terminal L2, the current of the grounding conductor PE to the terminal PE, the current of the neutral conductor N to the terminal N, and the current of the phase conductor L1 to the terminal L1.

Figure 8:
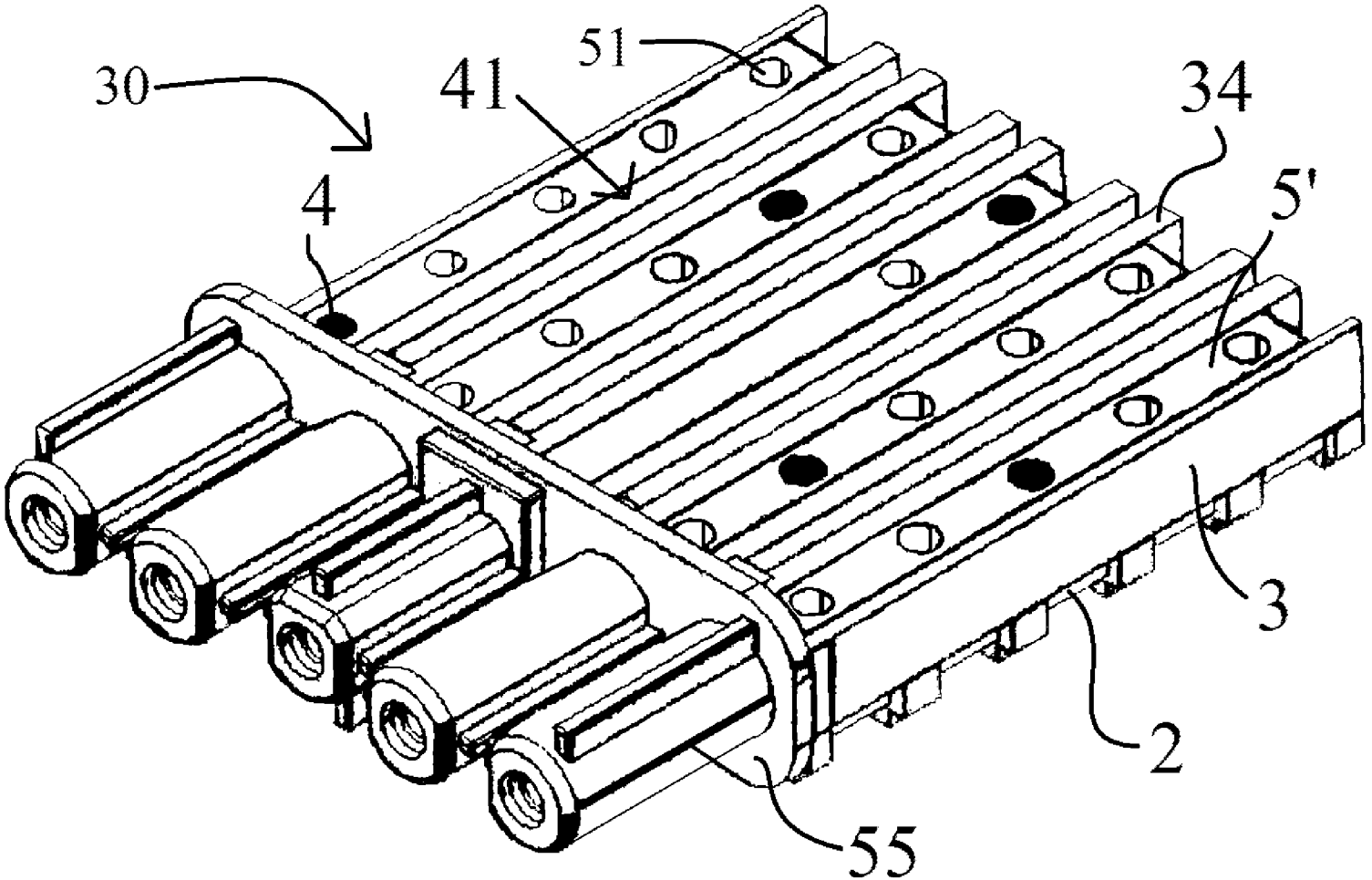
FIG. 8 is an example of a slide-in unit with a first arrangement of contact pins in five terminal rails.

A complete slide-in unit 30 with a first arrangement of contact pins 41 "Code 1" is shown in FIG. 8. In the slide-in unit 30, a socket attachment 55 is placed on the terminals 5 to protect them from contact with dust or water or to protect an installer or user from touching the terminals 5. The structure of the slide-in insulator 3 with cross-connectors 2, receptacles 34 for the terminals 5 and the terminal rails 5' inserted therein is similar to the arrangements described in FIG. 1, FIG. 4 and FIG. 6. The contact pins 4 are inserted into certain holes 51 in the terminal rails in order to connect certain terminal rails 5' and thus terminals 5 to certain wires 101 of the flat cable 100 (see, for example, FIG. 7). In the contact pin arrangement shown in FIG. 8, the wires 101 of the flat cable 100 are connected to the terminals in the order shown in FIG. 7, for example.

Figure 9:
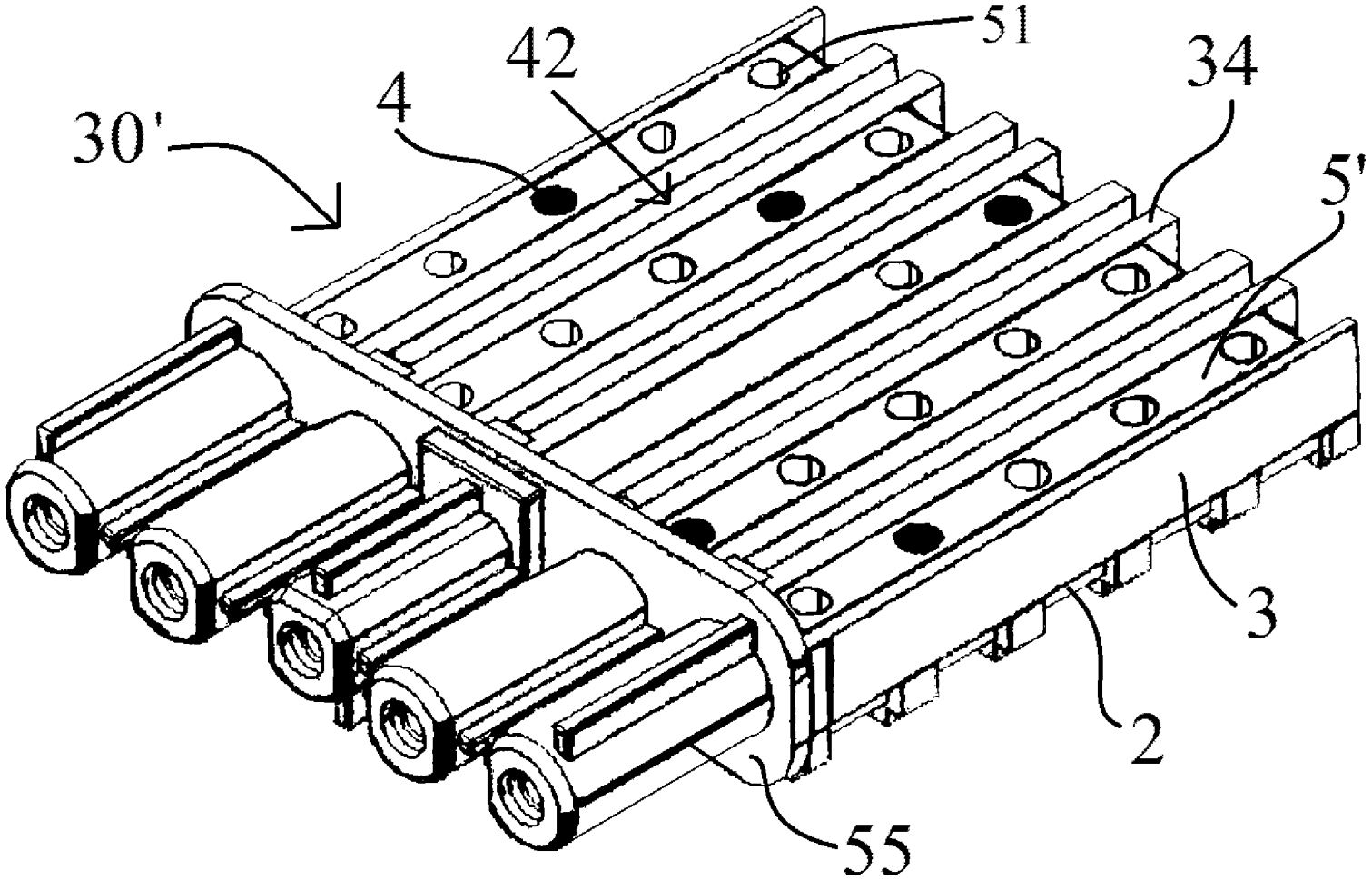
FIG. 9 is an example of a slide-in unit with a second arrangement of contact pins in five terminal rails.

FIG. 9 shows a slide-in unit 30' which is similar to the slide-in unit 30 in FIG. 8 except for the arrangement of the contact pins 4. The arrangement of the contact pins 42 in the terminal rails 5' of the slide-in unit 30' connects, in the direction of insertion for cable wires in the second flat cable 150 (see FIGS. 19A, 19B), the terminal rail 5' located on the extreme left to the third cross-connector 2 from the front, the terminal rail 5' located on the extreme right to the fourth cross-connector 2 from the socket attachment side, the terminal rail 5' located in the middle to the rearmost cross-connector 2, the terminal rail 5' located to the right of the middle to the frontmost cross-connector 2, and the terminal rail 5' located on the extreme right to the second cross-connector 2.

If, as shown in FIG. 7, the cross-connectors are provided with contact blades 1 placed in a diagonal pattern from the socket side to the rear (see, for example, FIG. 1), the contact blade 1 of the cross-connector 2 located directly behind the socket attachment 55 contacts the phase L3. The contact blades of the cross-connectors 2 behind them contact the wires 101 in the following order: L2, L1, N, PE, as also shown in FIG. 7.

Thus, under this contact pin 42 arrangement, there is a connection of the phase conductor wire L1 to the leftmost terminal rail, of the neutral conductor wire N to the adjacent terminal rail, of the grounding conductor wire PE to the middle terminal rail, and of the phase conductor wires L2 or L3 to the two rightmost terminal rails.

Figure 10:
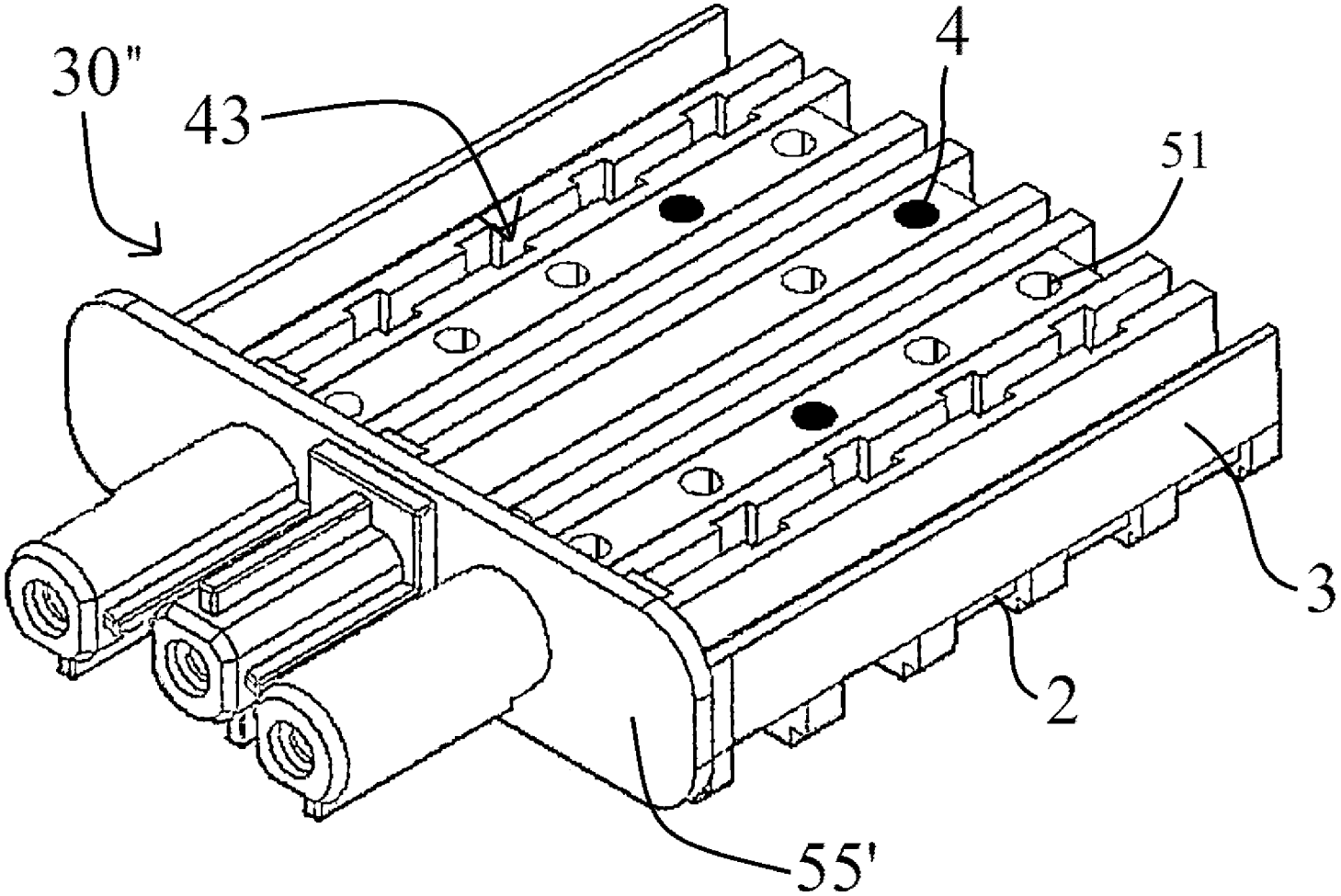
FIG. 10 is an example of a slide-in unit with an arrangement of contact pins in three terminal rails.

A slide-in unit 30" with only three terminal rails 5' accommodated in it, which are provided with contact pins in order to be electrically connected to only three cross-connectors 2, is shown in FIG. 10. Here, for example, only three wires are tapped from a five-wire flat cable. Assuming that the contact blades of the cross-connectors in FIG. 10 are arranged in the same way as the cross-connectors Q3, Q4 and Q5 in FIG. 7, the terminal rail 5' on the extreme right as seen from the socket attachment 55' here contacts the phase conductor wire L1, while the middle terminal rail 5' contacts the grounding conductor wire PE and the terminal rail 5' on the extreme left contacts the neutral conductor wire N. The socket attachment 55' accommodates the corresponding three terminals 5 (see, for example, FIG. 4) and protects them against the entrance of dust and water or provides protection against contact with the electrically conductive parts.

Figure 11:
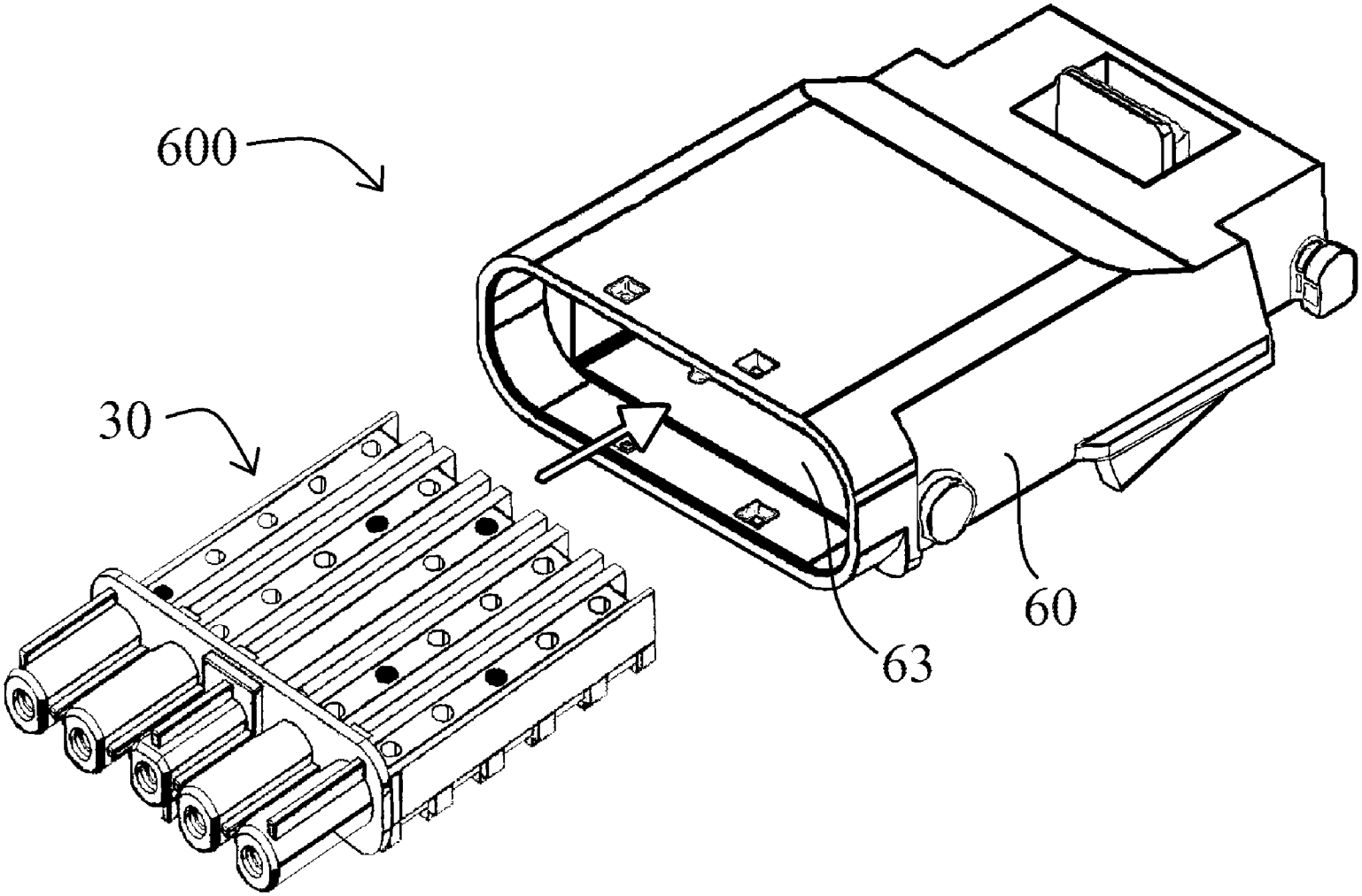
FIG. 11 is an example of a slide-in unit as received in a sleeve belonging to a first part of the junction box.

As schematically shown in FIG. 11, a slide-in unit 30 (or also a slide-in unit 30' or 30" as shown in FIGS. 9 and 10) is inserted through an opening 63 into a sleeve 60. This sleeve, together with contact blades inserted therein for the cross-connectors 2 (see, for example, FIG. 2, FIG. 3) and possibly other elements, forms a first portion 600 of the junction box 200 (see FIGS. 15, 16, 19A, 19B). The sleeve 60, for example, provides a watertight and dust-tight cover for the slide-in unit 30 and the sealing attachment 65 (see FIG. 15) so that a seal according to protection class IP68 can be achieved. One or more sealing rings can be provided for this purpose, or the contact blades 1 can be provided with seals. Without a sealing attachment 65 (see FIG. 15), for example, only sealing in accordance with a lower protection class is possible.

Figure 12:
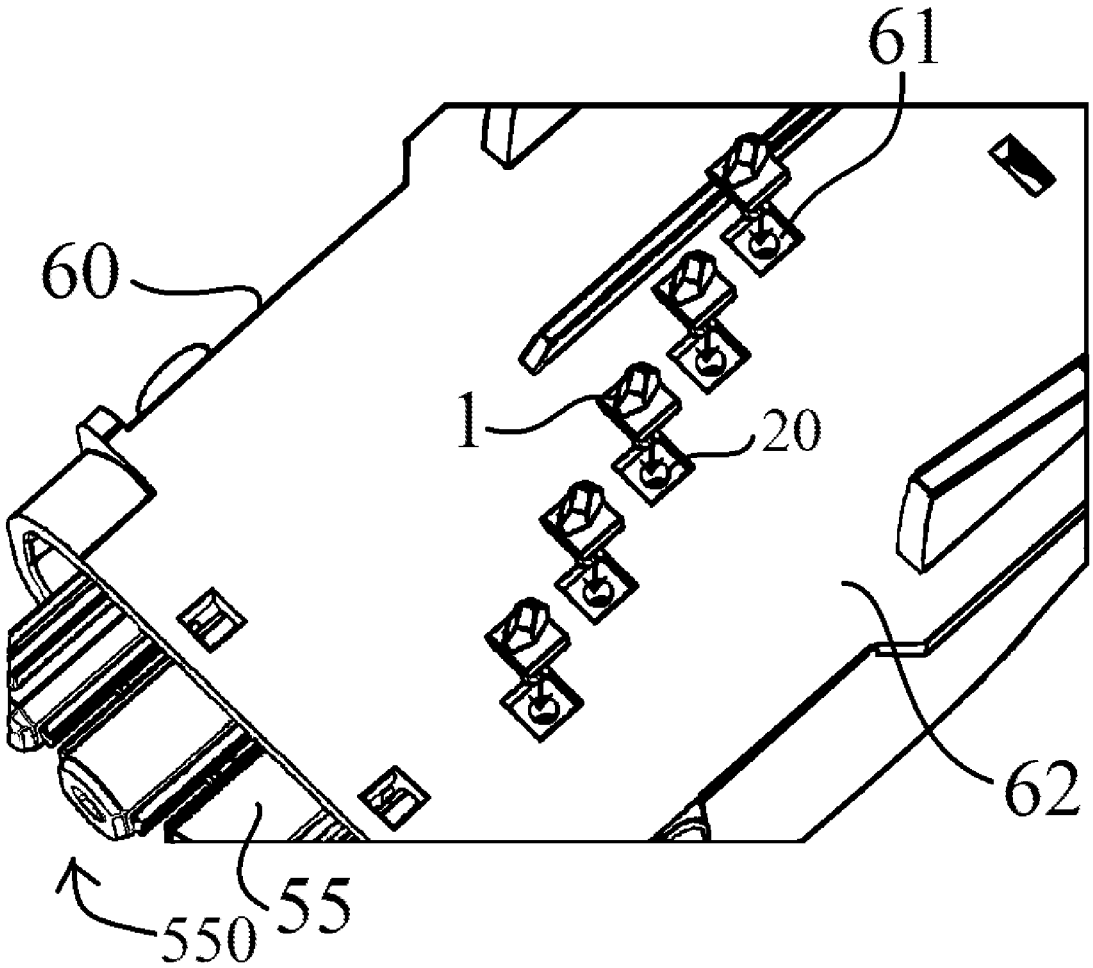
FIG. 12 illustrates the sleeve from FIG. 11 with inserted slide-in unit, with contact blades inserted on its underside.

FIG. 12 shows how contact blades 1 are inserted through openings 61 on the underside 62 of the sleeve 60 shown in FIG. 11. A seal is achieved between the contact blades 1 and the flat cable 100 by applying a seal around the contact blades 1. The underside 62 of the sleeve 60 is the side that is pressed against the flat cable 100 to be contacted (see, for example, FIG. 7). These openings 61 overlap with the holes in the first row of holes 2' in the cross-connectors 2 located at the slide-in unit 30. Thus, the contact pins are inserted from the outside through the bottom of the first portion 600 of the junction box (see FIGS. 15, 16, 19A, 19B) into the holes 20 of the first row of holes 2' in the cross-connector. The socket attachment 55 of the connection 550 protrudes from the sleeve 60.

Figure 13:
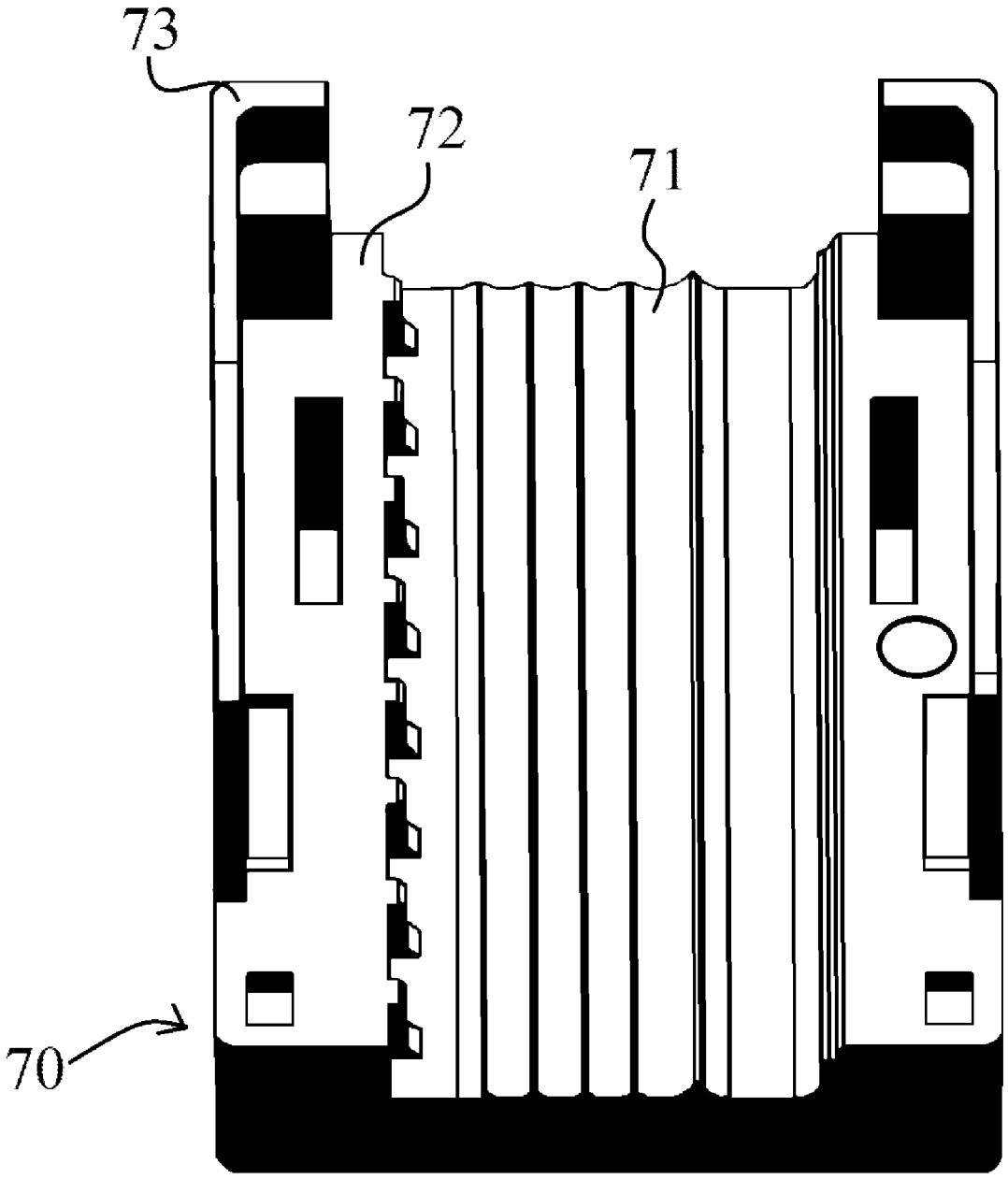
FIG. 13 is an example of a second part of the junction box comprising the support surface for the flat cable.

A second portion 70 of junction box 200 is shown in FIG. 13. This second portion 70 is provided with a support surface 71 for the flat cable 100 (see, for example, FIG. 7, FIG. 16). The support surface is designed, for example, to match the contour of a flat cable 100 resting thereon (see, for example, FIG. 7, FIG. 16). This prevents the flat cable 100 (see, for example, FIG. 7, FIG. 16) from being inserted incorrectly. Further protection in this respect is also provided by a coding 68 on the underside 62 of the sleeve 60, see also FIGS. 14, 14A-14C.

The second portion 70 of the junction box 200 also includes side walls 73 into which the first portion 600 of the junction box 200 (see FIGS. 14, 15, 16) can be inserted. This first portion 600 of the junction box 200 may thereby be supported on a support surface 72, which may be positioned adjacent to the support surface 71 for the flat cable 100.

Figure 14:
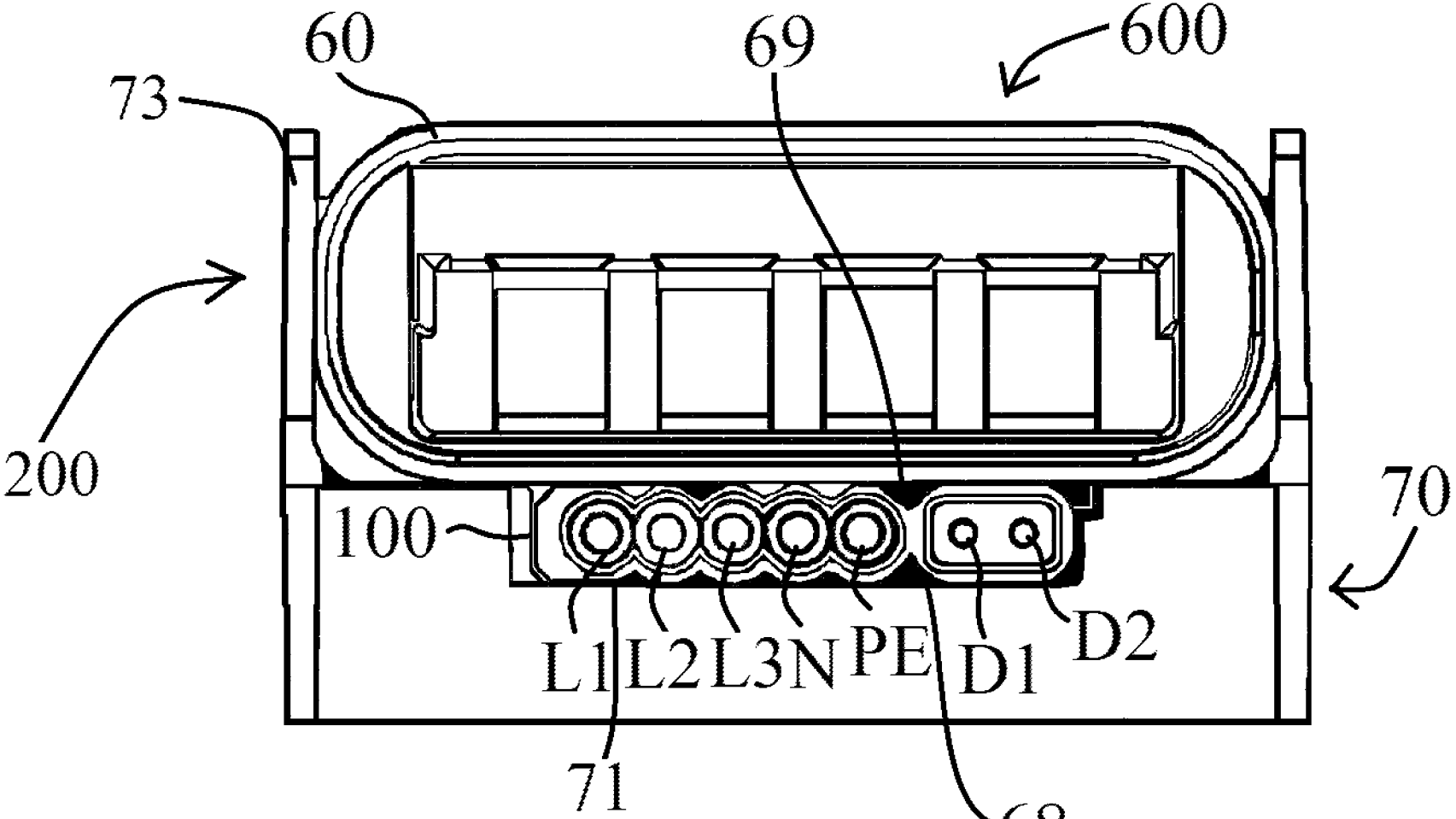
FIG. 14 is an example of a sectional view through a complete junction box comprising the first and second parts.

FIG. 14 shows a sectional view of a junction box 200, wherein the first portion 600, with a slide-in unit 30, 30', 30" inserted into the sleeve 60 (see FIGS. 8, 9, 10), is inserted in the second portion 70 to contact a flat cable 100 via the contact blades 1 projecting from the sleeve 60. Laterally, the first portion 600 is protected from slipping by side walls 73 of the second portion 70. The flat cable 100 shown here is a flat cable 100 with seven cable conductors: five cable conductors for power supply (phase conductors L1, L2, L3, neutral conductor N, grounding conductor PE) and two data conductors D1, D2.

For example, the combination of the first portion 600 inserted into the second portion 70 forms the entire junction box 200.

The contact surface 71 of the second portion 70 of the junction box 200 is shaped, for example, to fit the contour of the inserted flat cable 100. This particular shape of the support surface forms a coding 68 of the support surface 71. Similarly, at least a portion of the underside 62 of the sleeve 60 is shaped, for example, to conform to the top surface of the flat cable 100 when the junction box 200 is closed. This shape forms a coding 69 of the underside 62 of the sleeve 60 (of the first portion 600). For example, the two codings 68, 69 ensure that the flat cable 100 can only be inserted with the correct orientation and thus form a safeguard against twisted insertion of the flat cable. In addition, the codings 68, 69 ensure, for example, that only those flat cables 100 for which the junction box 200 is designed can be inserted in order to be tapped or mounted.

Figure 14A:
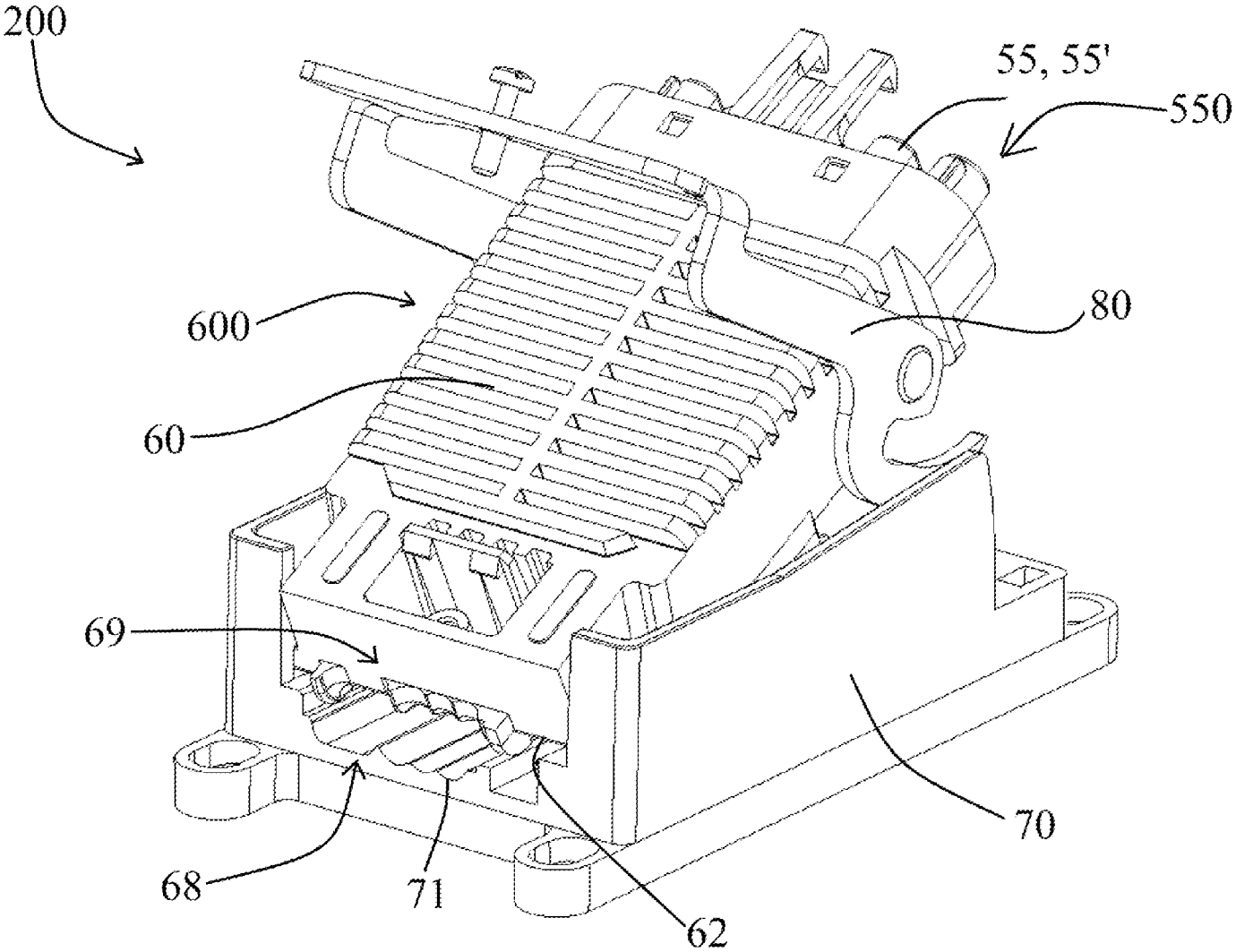
FIGS. 14A to 14C show exemplary views of a complete multi-part junction box in open as well as closed state and an exploded view.
Figure 14B:
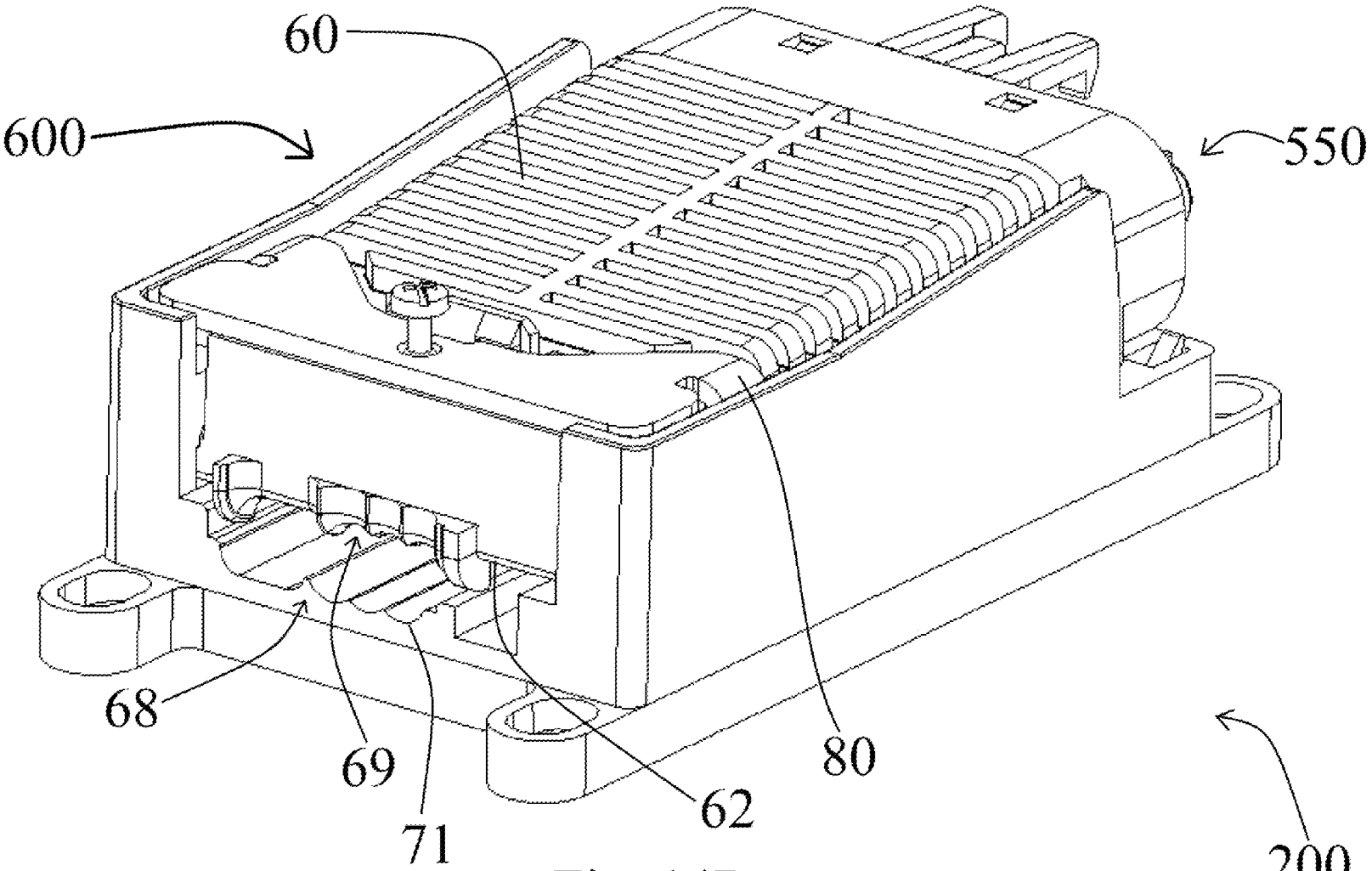
Figure 14C:
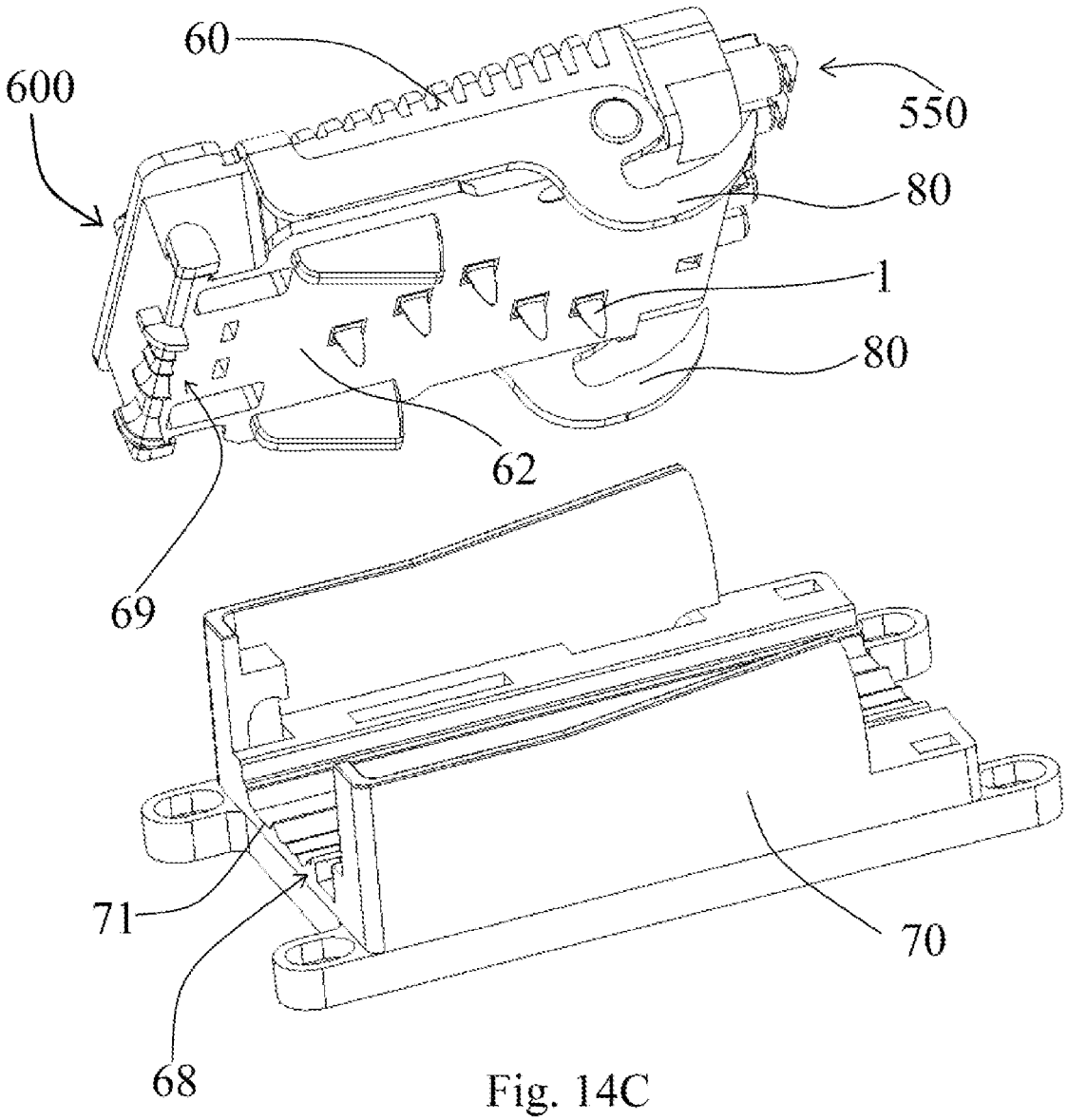

FIG. 14A illustrates junction box 200 in an open state. The connection 550, which is protected by a socket attachment 55, 55' against contact and penetration of moisture, etc., protrudes from the sleeve 60. For example, the connection 550 can be configured so as to accept a plug 300 (see FIGS. 21, 22). A lever element 80 is rotatably mounted on the two long sides of sleeve 60. As already mentioned, the lever element 80 serves to press the sleeve together with the contact blade 1 inserted on the underside 62 against the flat cable 100 in order to contact the wires of the latter without stripping on one side.

Figure 15:
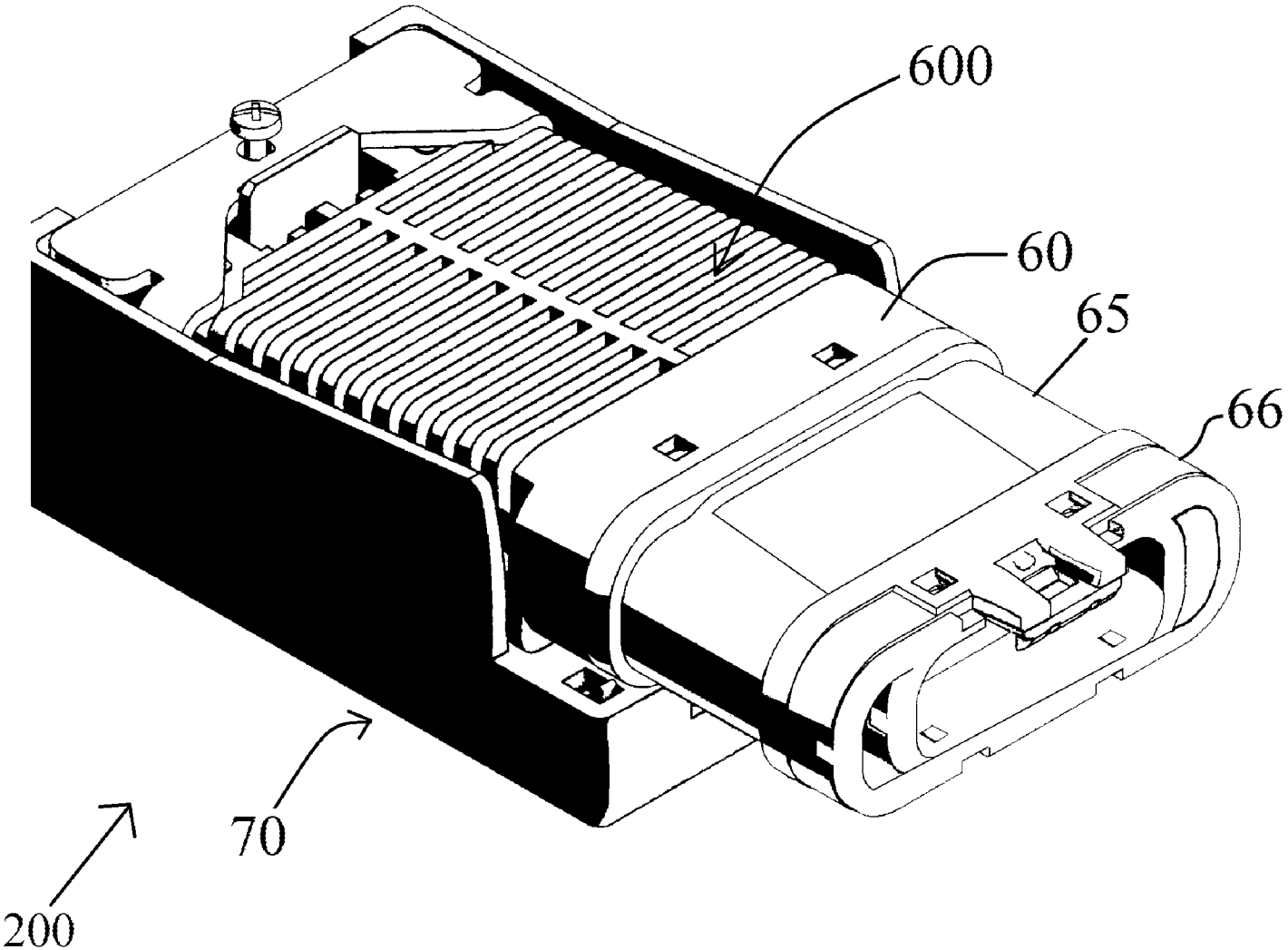
FIG. 15 is an example of a top view of a junction box comprising the first and second parts.

The two codings 68, 69 mentioned above can be seen in FIGS. 14A to 14C on the side of the junction box 200 opposite the connection 550. The coding 68 is attached to the support surface 71 for the flat cable 100 and extends along the entire length of the support surface 71, as shown in particular in the exploded view FIG. 14C. In contrast, the coding 69 is attached to the rear side of the sleeve 60 opposite the connection 550 and only partially along the underside 62 of the sleeve 60. This is sufficient because this compact design of the coding 69 also prevents the junction box 200 from being closed with a flat cable 100 inserted in the wrong orientation or even a flat cable not intended for this box in order to contact the wires of the flat cable by means of the contact blades 1. An external view of an example of such a junction box 200 is shown in FIG. 15. In this example, the first portion 600 has a pair of sequential sealing attachments 65, 66—which attach, for example, to a socket attachment 55, 55' of a slide-in unit 30, 30' 30" not shown here (see FIGS. 8-11)—to increase the dust- and watertightness of the overall device. For example, a seal in accordance with protection class IP68 can be achieved this way.

Figure 16:
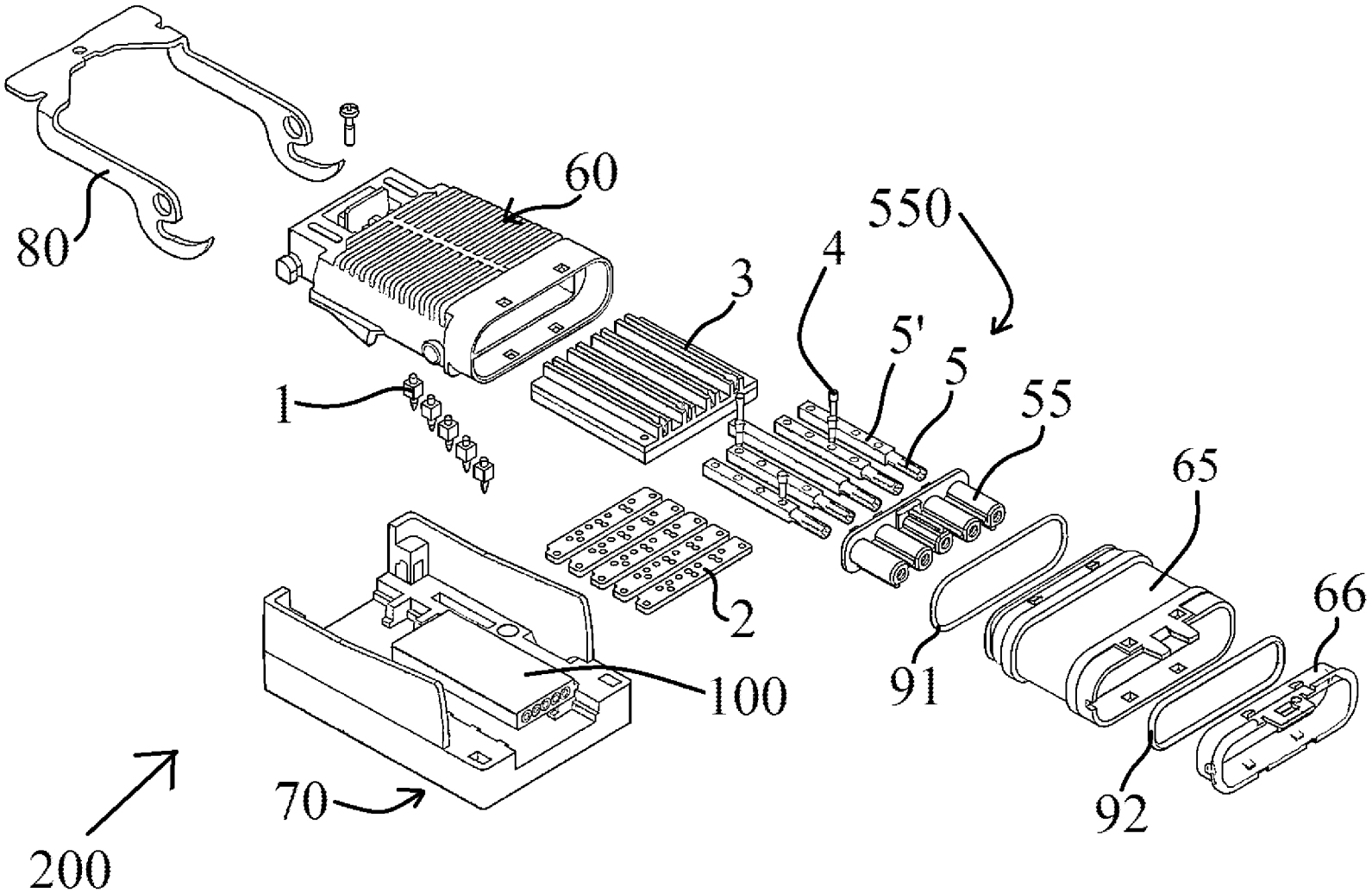
FIG. 16 is an example of an exploded view of a junction box comprising the first and second parts.

FIG. 16 shows an exploded view of one possible embodiment of a junction box 200 including an inserted flat cable 100.

The flat cable 100 is placed on the support surface 71 (see FIG. 13) in the second portion 70. The five cable wires 101 of the flat cable 100 shown here are tapped without stripping via, in this example, five contact blades 1, each wire 101 via a different contact blade 1. Each of these contact blades 1 is inserted into a hole 20 in a different cross-connector 2, in this case into a hole in the first row of holes 2' (see FIG. 2), and passes current or electrical data signals to these cross-connectors 2.

The cross-connectors are placed in receptacles on the underside of a slide-in insulator 3, and the terminal rails 5' on its upper side (see FIG. 4, FIG. 6, FIGS. 8-10). The terminal rails 5' are one-piece continuations of terminals 5 which can be clamped to the wires of a second cable. The terminal rails 5' have holes arranged in succession, through which contact pins 4 are inserted. These contact pins 4 pass through these same holes 51 in the terminal rails 5' (see FIG. 4), through holes 31 (see FIG. 5) in the slide-in insulator 3, and reach holes 20 in a second row of holes 2' on the cross-connectors 2 (see FIG. 2). The contact pins 4 thus pass current through the slide-in insulator 3 to the terminals 5 via the cross-connectors 2 from the cable wires 101 of the first flat cable 100.

The terminals 5, for their part, are received in a socket attachment 55. This socket attachment is coupled to additional sealing attachments 65, 66, which have O-rings 91, 95 at their connection points to provide additional protection against the entrance of dust and water. The terminals, along with the socket attachment and possibly other elements, together form the connection 550 of the junction box 200, for example.

The slide-in insulator 3 together with the cross-connectors 2, terminal rails 5' and socket attachment 55 form a slide-in unit 30 which is inserted into the sleeve 60 (see FIG. 11). The sealing sleeve 60 then also has the sealing attachments 65, 66 coupled to it.

For example, at the rear end of this sleeve there is an anchor point for a lever element 80 which is used to press the sealing sleeve 60, together with the contact blades 1 (see FIG. 12) inserted on the underside 62 (see FIG. 12), against the flat cable 100 located on the support in order to contact the latter without stripping and to allow the flow of current from the contact blades 1 to the terminals 5.

In FIGS. 16A to 16H, different variants of the junction box 200 are shown which differ from each other by the arrangement or assignment of the flat cable wires 100, by the type of flat cable (five-wire flat cable without data conductor or seven-wire with data conductor), and by the arrangement of the contact blades 1 in the first row of holes 2' in the cross-connectors 2 or by the arrangement of the contact pins 4 in the terminal rails 5'. Accordingly, in FIGS. 16A to 16H, the currents or signals of different flat cable wires are applied to different cross-connectors 2. The different signals or currents applied to the cross-connector 2 are passed to the respective terminals 5 via the contact pins 4 and terminal rails 5'. Which wire of the flat cable 100 is connected to which terminal is determined in this example, on the one hand, by the arrangement of the contact blades 1 in the cross-connectors 2 and, on the other hand, by the arrangement of the contact pins 4 in the terminal rails 5'.

The configurations shown in FIGS. 16A to 16H are now described in detail as follows.

Figure 16A:
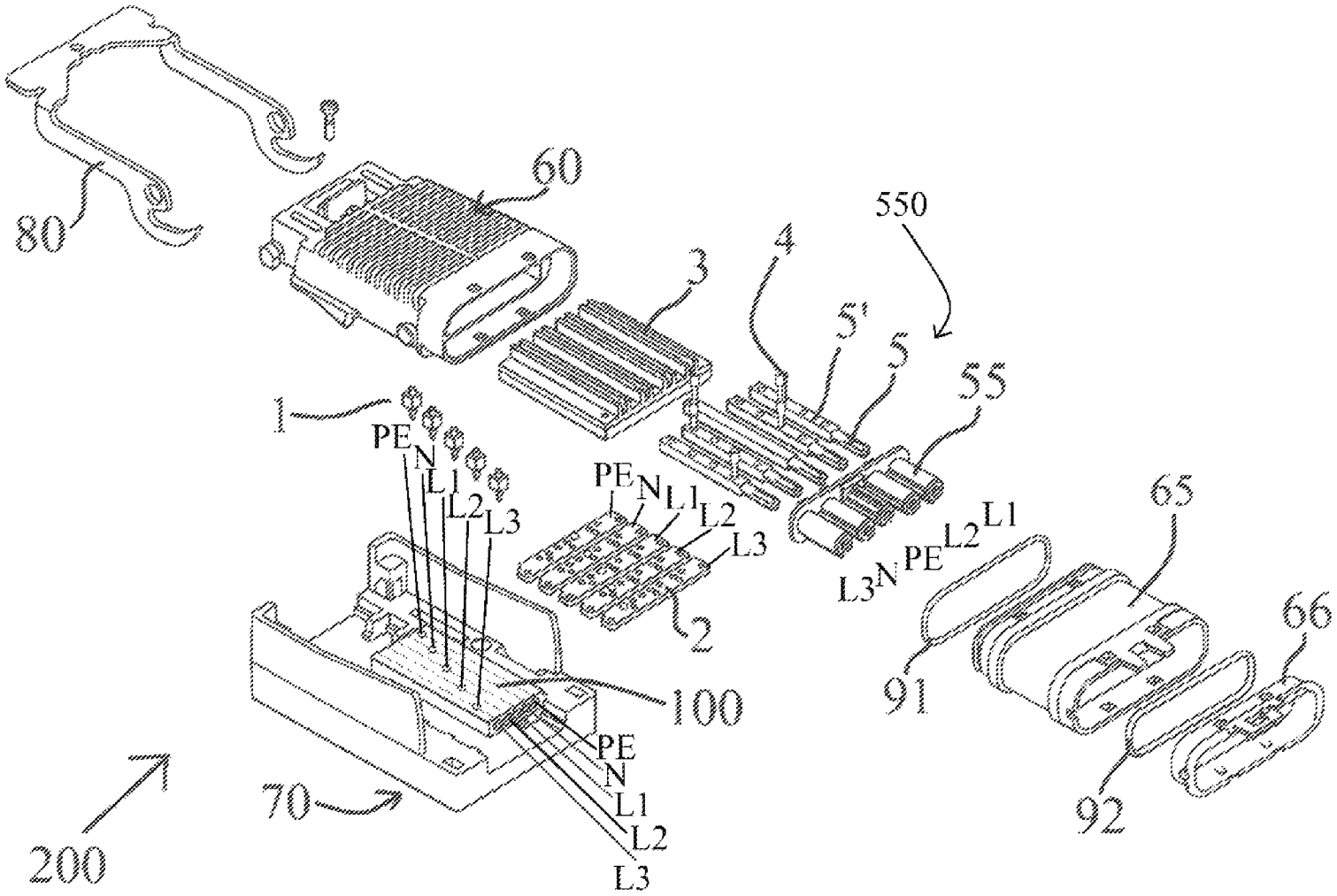

FIG. 16A shows an arrangement referred to here as "3LNPE-1". The flat cable 100 has five wires, and from the flat side to the tapered side of the flat cable the wires have the following assignments: Phase L3, phase L2, phase L1, neutral conductor N, grounding conductor PE. The contact blades 1 are placed within the row of holes 2' in the cross-connectors 2 in such a way that the cross-connector 2 farthest away from the terminals 5' (that is to say, rearmost) is connected to the grounding conductor wire PE. The adjacent cross-connector is connected to the neutral conductor N via a contact blade 1' inserted into the corresponding hole. The middle cross-connector 2 as well as the two (front) cross-connectors closest to the terminals 5 are each connected from rear to front to the phase conductor wires L1, L2 L3.

Accordingly, with the given configuration of the contact pins, the terminals 5 have the following assignment (seen from left to right frontally from the slide-in side): L3, N, PE, L2, and L1.

Figure 16B:
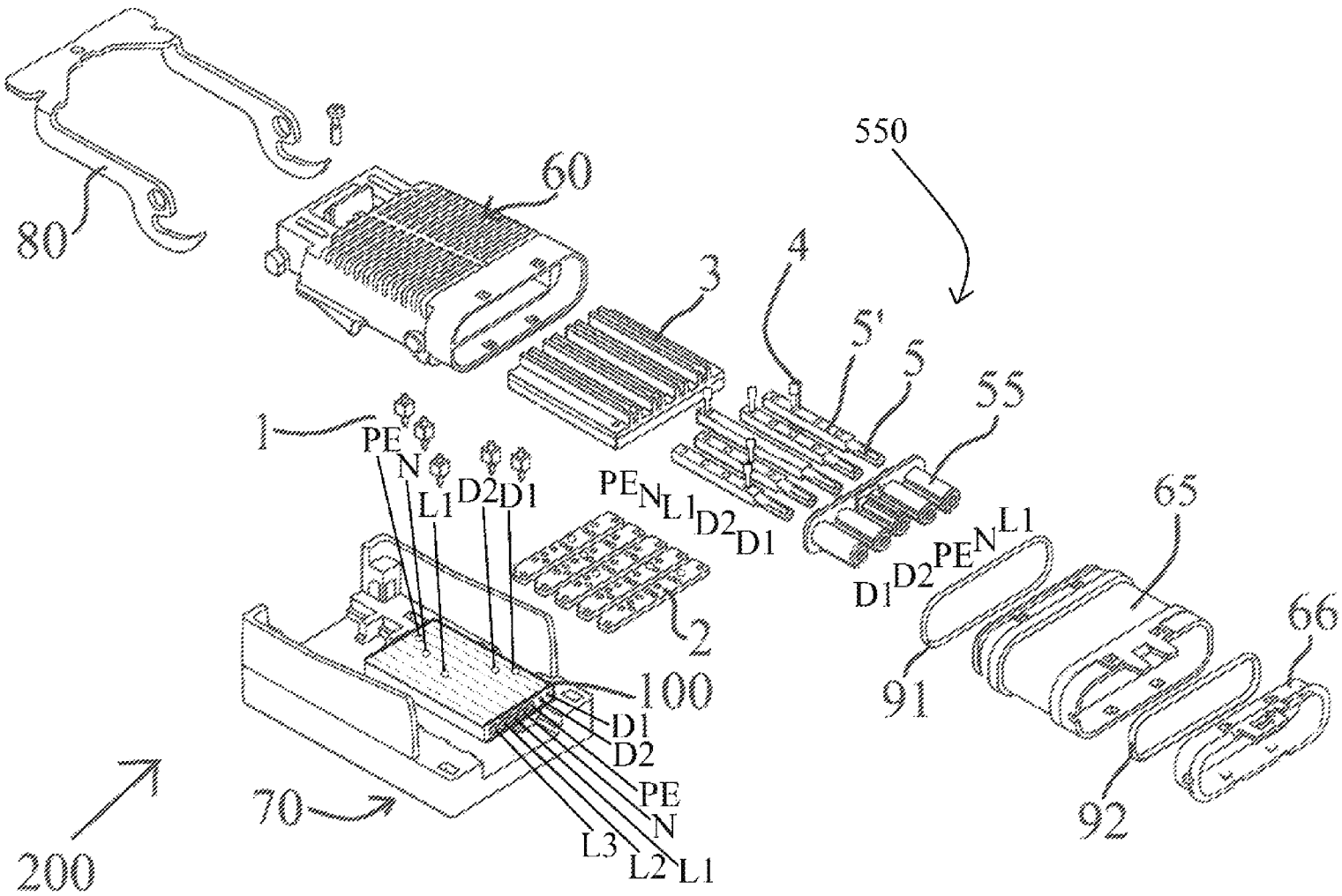

In the configuration "L1NPE-Bus(1)" shown in FIG. 16B, a seven-wire cable is tapped which, in addition to the wires L3, L2, L1, N, PE already known from FIG. 16A, also has the data conductors D1 and D2; these are arranged in the flat cable 100 next to the five phase conductors or neutral conductor and grounding conductor.

In this configuration, even though the flat cable 100 has seven wires, there are still only 5 contact blades 1, cross-connectors 2, and terminals 5 provided to tap only five of these wires and apply their signal to terminals 5 of the connection 550.

In this configuration, the rearmost cross-connector 2 is connected to the PE wire, the next one seen in the direction of terminals 5' to the N wire, the next one to the L1 wire, the next one to the D2 wire and the foremost one to the D1 wire.

This arrangement or assignment of the contact pins 4 thus results in the following assignment of the terminals (from left to right frontally as seen from an outlet to be coupled to the terminals): D1, D2, PE, N, L1. So here only one phase (the L1 phase) is connected to the connection 550, as well as a neutral conductor, a grounding conductor and two data conductors.

In the "L2NPE+Bus(1)" configuration shown in FIG. 16C, the flat cable 100 is identical to that shown in FIG. 16B. However, in comparison to the illustration 16B, it is not the phase L1 that is connected to the cross-connector 2 but rather the phase L2. As the result of this, this phase L2 of the flat cable 100 is connected to the terminal 5 for phase L2 and not L1.

In the configuration shown in FIG. 16D "L3NPE+Bus(1)," the phase L3 is accordingly connected to the middle cross-connector 2 and, given the configuration of the contact pins 4, to the terminal 5 for the phase L3.

In FIG. 16E, a configuration with a five-wire flat cable 100 is shown, but the cable wires have a different assignment than in 16A. This configuration is referred to as "3LNPE-2" in the figure. Here, the sequence of phase conductors or neutral conductors and grounding conductors in flat cable 100 from left to right (from flat side to tapered side) is as follows: L1, N. PE, L2, L3. The neutral and grounding conductor is thus arranged here in the flat cable 100 between the phase L1 and the phase pair L2, L3.

The contact blades 1 are arranged in the cross-connectors so that they are connected from rearmost to foremost in the order PE, N, L1, L2, L3 as in FIG. 16A. Therefore, the arrangement of the contact pins 4 shown in FIG. 16E results in assignment of the terminals 5 of the connection 550 as follows: The terminal 5 on the extreme left in frontal view from the point of view of an outgoing feeder coupled to the terminals is assigned with the phase L3, and those to its right are then correspondingly assigned with N, PE, L2, L1.

Figure 16F:
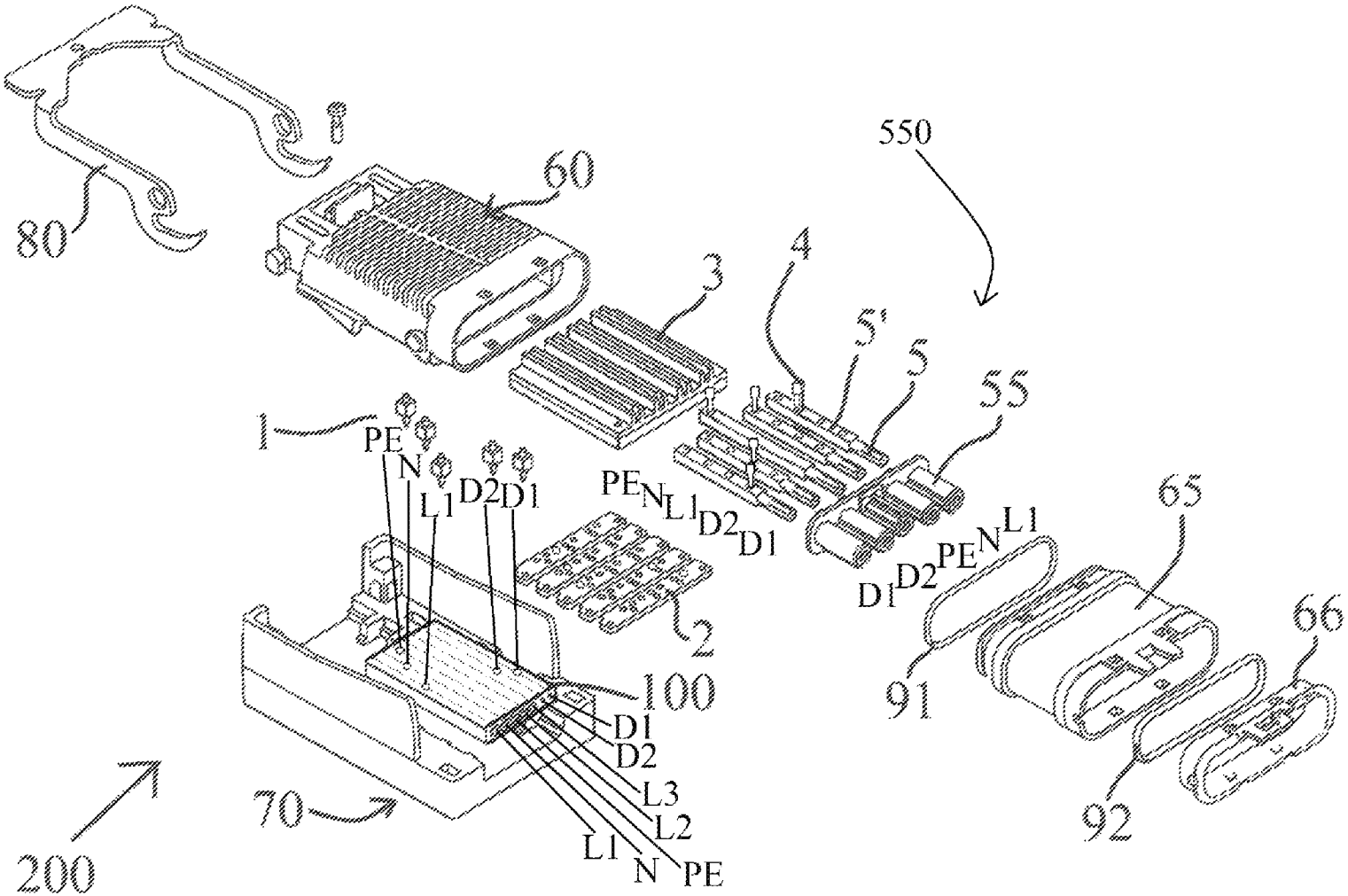

In the example shown in FIG. 16F, the flat cable 100 additionally has two data conductors D1, D2 compared to FIG. 16F, so the flat cable 100 has seven conductors here. However, five contact blades 1 here contact only for [sic] wires of flat cable 100, as in FIGS. 16B to 16D. In accordance with FIG. 16F, the contact blades 1 are arranged in such a way that the two rearmost cross-connectors 2 are assigned PE and N, starting from the rear. The middle cross-connector 2 is connected to the phase L1, the two front cross-connectors 2 to the data lines D2 and D1. Accordingly, in the exemplary arrangement of contact pins 4 shown in FIG. 16F, the two terminals on the far left are assigned the two data signals D1 and D2, while the middle terminal is assigned PE and the terminals on the right are assigned N or L1. This configuration is referred to as "L1NPE+Bus(2)" in FIG. 16F.

Figure 16G:
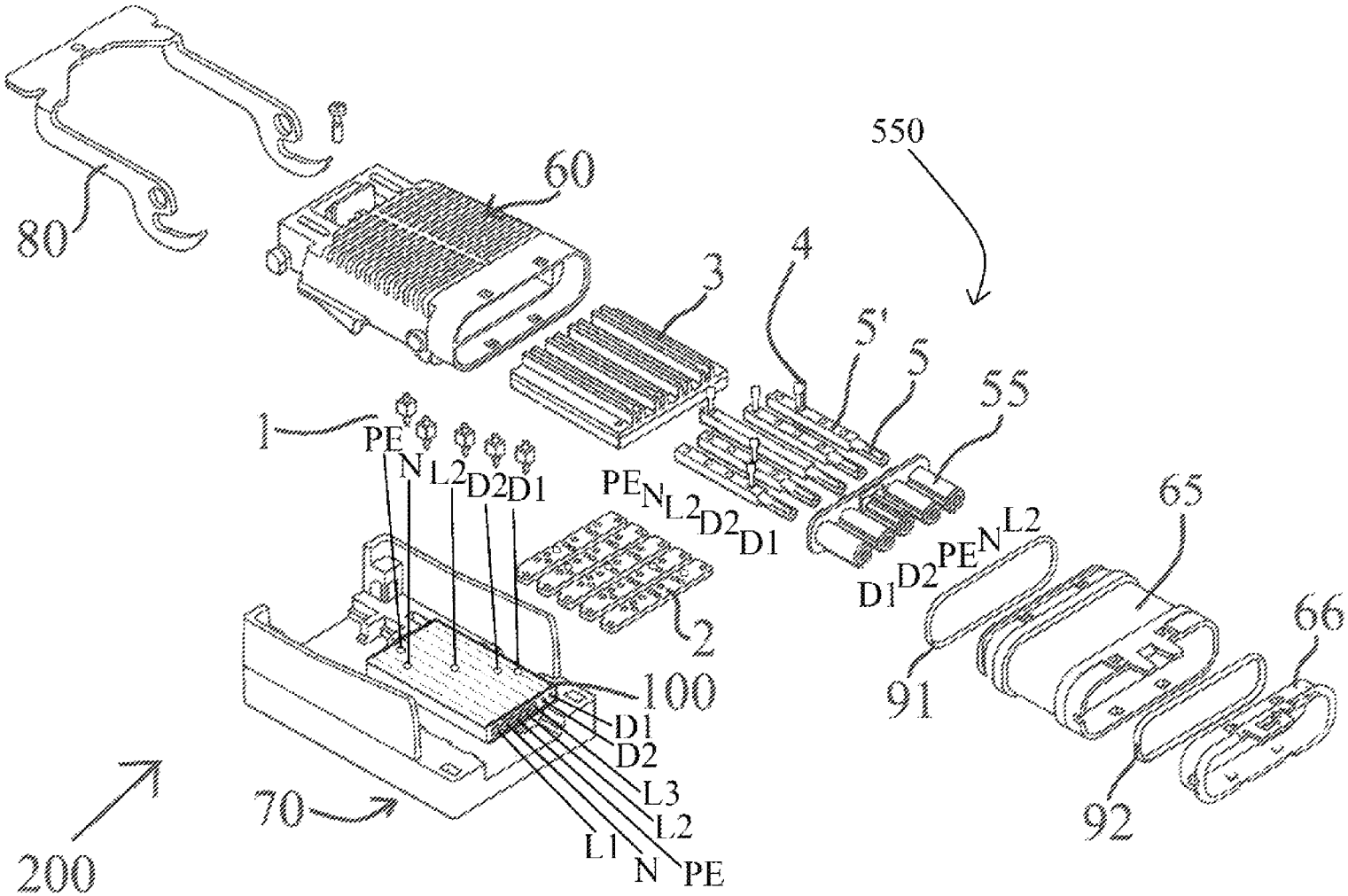

The "L2NPE+Bus(2)" configuration shown in FIG. 16G is the same as the configuration shown in FIG. 16F, except for the location of the contact blade 1 that contacts the center cross-connector 2. This contact blade 1 here is plugged into the middle cross-connector in such a way that the phase L2 is contacted. Accordingly, terminal 5 (assignment L2) on the far right is connected to wire L2 here.

Figure 16H:
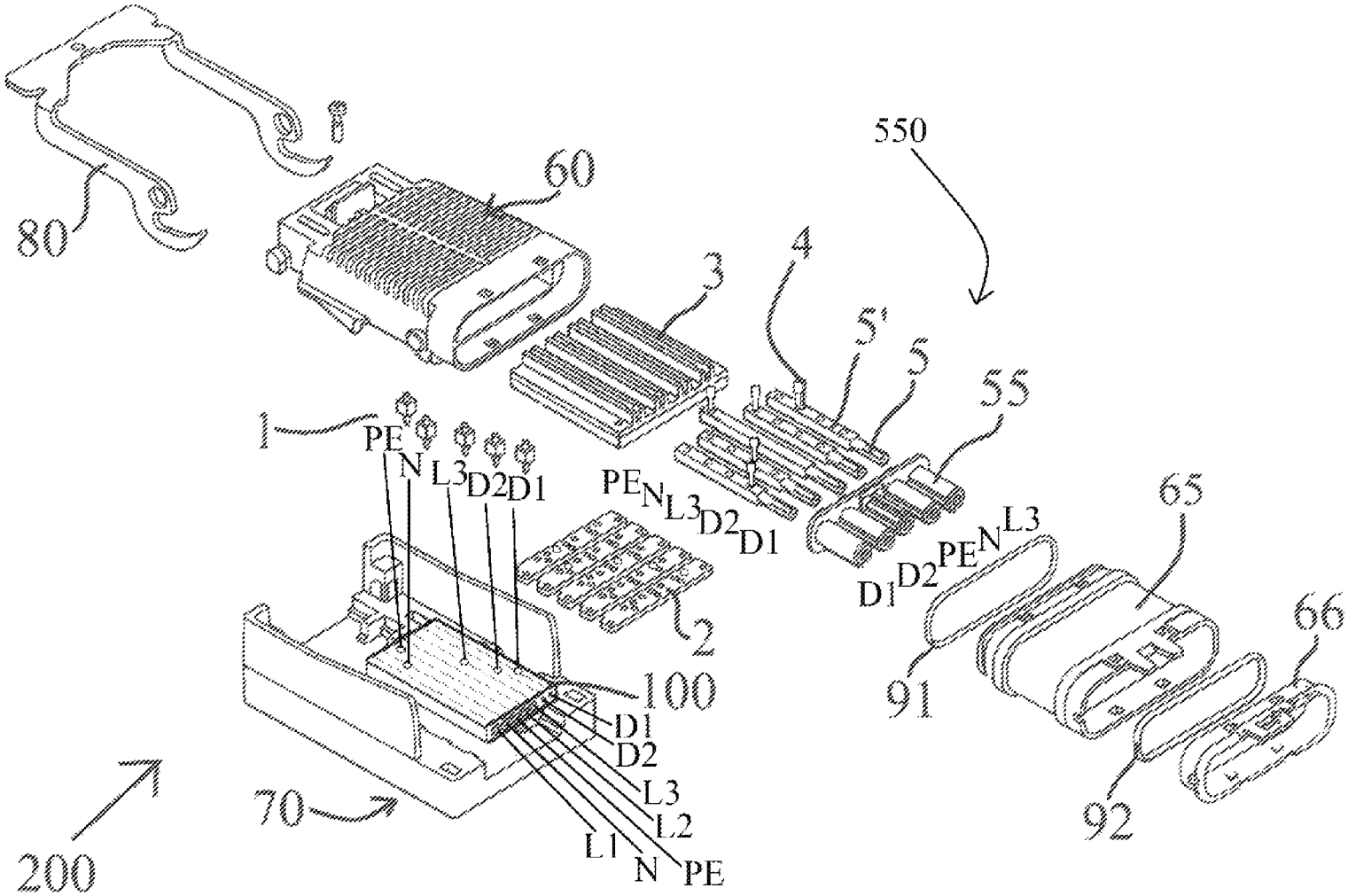

The configuration "L3NPE+Bus(2)" shown in FIG. 16H corresponds to the configuration shown in FIG. 16G, except for the position of the middle contact blade 1, which contacts the middle cross-connector. In this example, the phase wire L3 is contacted and connected to the rightmost terminal 5 of the connection 550.

Figure 17:
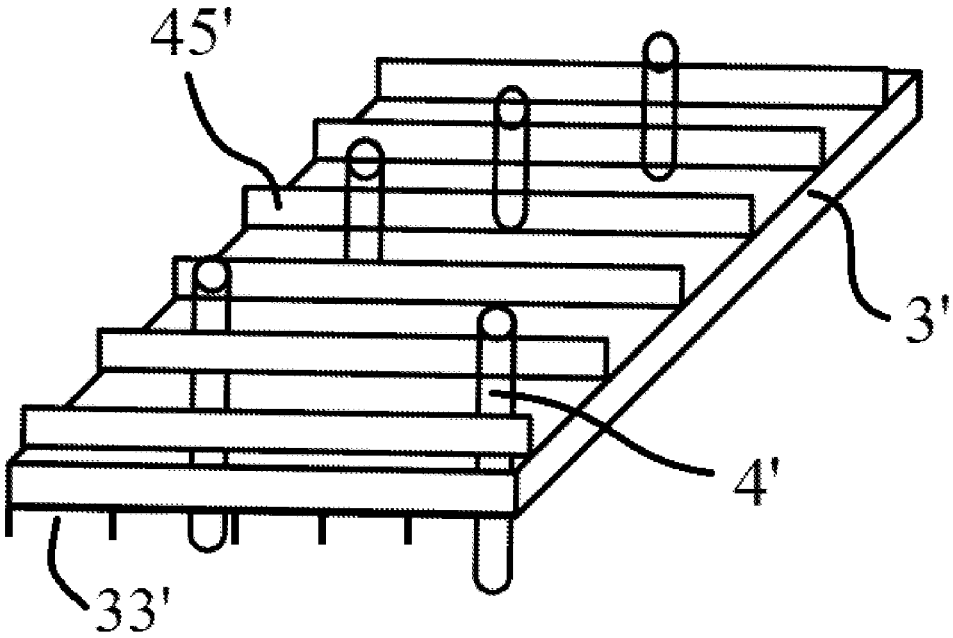
FIG. 17 is an example of a slide-in insulator with permanently inserted contact pins.

FIG. 17 shows an alternative embodiment of a slide-in insulator 3. The slide-in insulator 3' has fixed contact pins 4' whose two ends protrude from the top or bottom of the slide-in insulator 3'. In this case, the upper ends of the fixed contact pins 4' project into receptacles 45' for the terminal blocks 5' and their lower ends into receptacles 33' for the cross-connectors 2. There, the ends of the contact pins 4' can each be received in bores or holes in the terminal boards 5' or cross-connectors.

Figure 18:
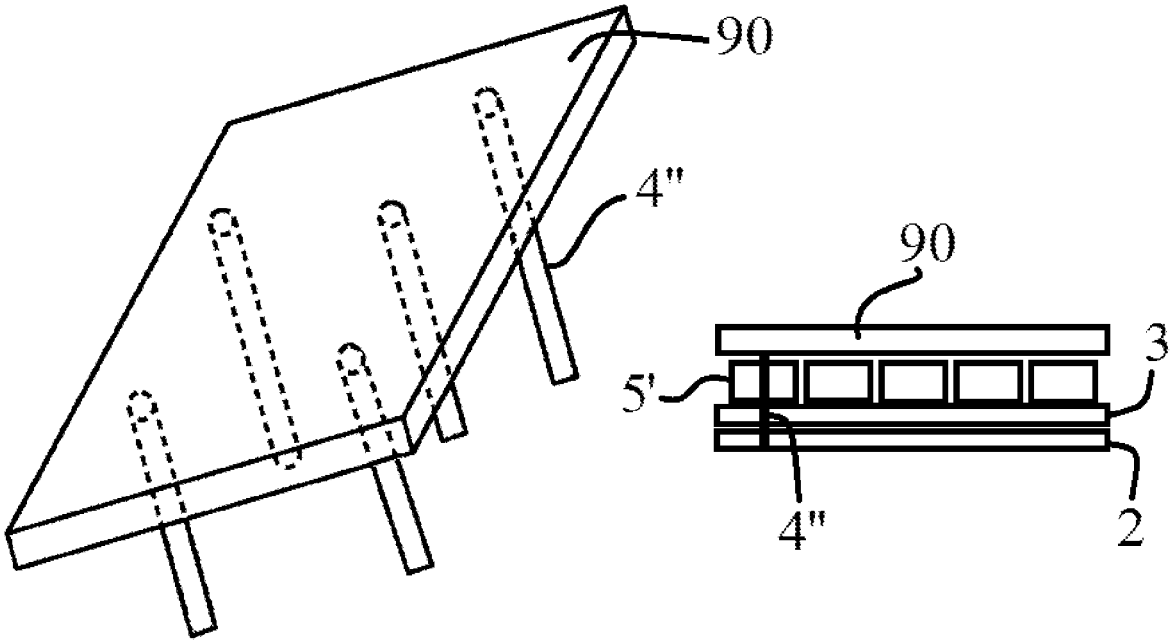
FIG. 18 is an example of an insulating pin plate to make the connection using contact pins all at once.

An insulating pin plate 90, which is another alternative way of making the electrical connection between terminal rails 5' and cross-connectors 2, is shown in FIG. 18.

In this alternative, contact pins 4" protrude out of the insulating pin plate on one side, wherein when the plate is pressed onto the terminal rails 5' inserted into the slide-in insulator, the contact pins 4" are driven through the terminal rails 5' and the slide-in insulator 3 and into the holes in the second row of holes 2" (see FIG. 2). This quickly establishes electrical contact in just one step. The contact pins 4" can be pressed in by applying pressure to the insulating pin plate 90 in the direction of the terminal rails 5' via a lever element 80 (see FIG. 16).

In other embodiments, such as FIG. 4, the contact pins 4 are inserted individually.

Figure 19B:
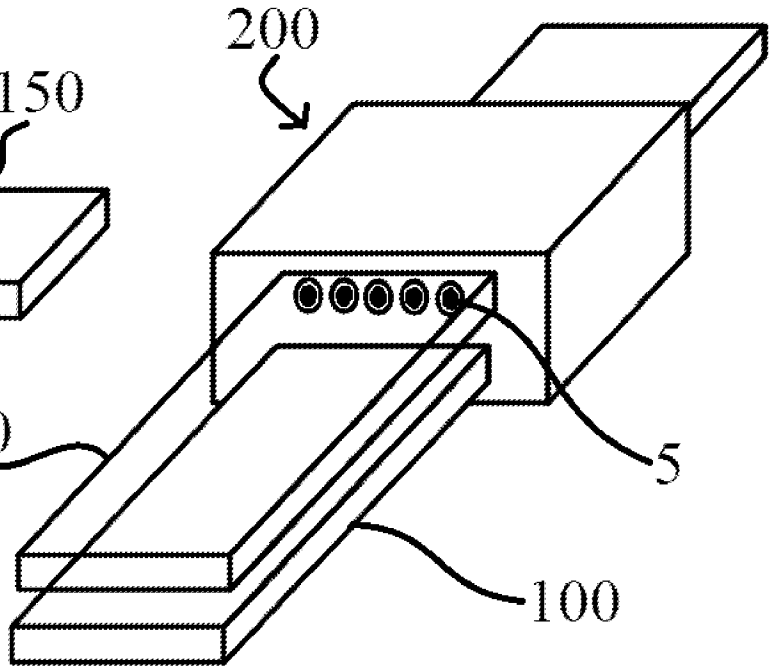
FIG. 19B is an example of a junction box connecting two flat cables running parallel to each other.
Figure 19A:
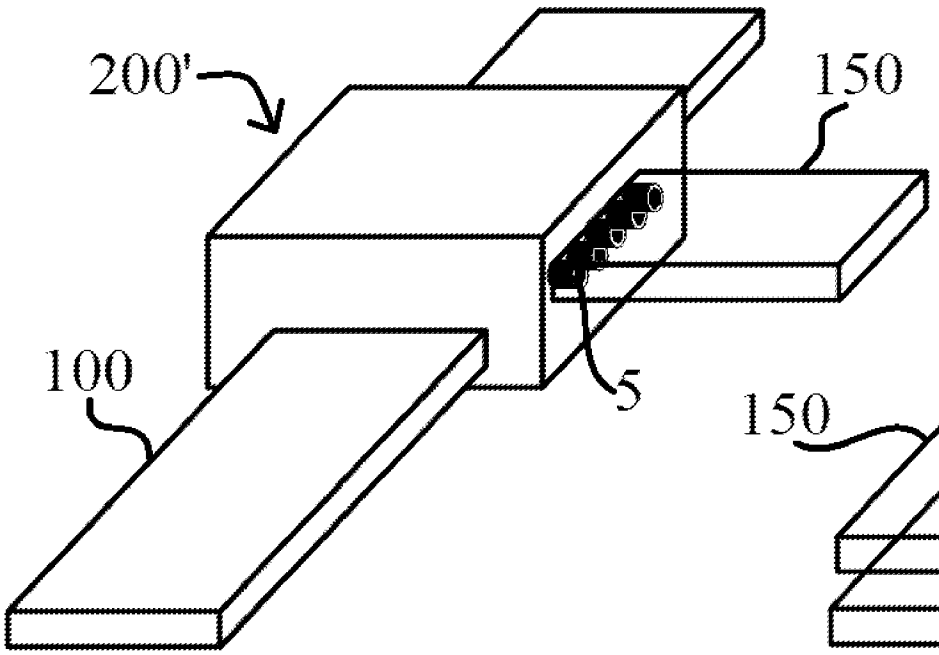
FIG. 19A is an example of a junction box that connects two flat cables that are perpendicular to each other.

Two different examples of using a junction box 200, 200' in accordance with the invention are shown in FIGS. 19A and 19B. As shown in FIG. 19A, one embodiment of the junction box 200' can be used to connect two flat cables 100 and 150, respectively, arranged at right angles one above the other. Here, the first flat cable 100 makes contact without stripping in the junction box 200' and current is delivered to terminals 5, which are arranged at right angles to the direction of passage of the first flat cable, to which a second flat cable 150 is coupled. The terminal rails 5' (not visible in FIG. 19A) directly cross the cable wires of the first flat cable 150 here. The contact pins and contact blades can be directly connected here (for example, designed as a single component) in order to provide current from a cable wire to a terminal. Cross-connectors 2 (see FIG. 2) can also be omitted in this embodiment.

As shown in FIG. 19B, however, the terminals 5 can also be arranged in parallel above the first flat cable 100 that has been passed through in order to couple a second flat cable 150 there to the first flat cable. Here, for example, the junction box 200 can be designed as shown in FIG. 16.

Figure 20B:
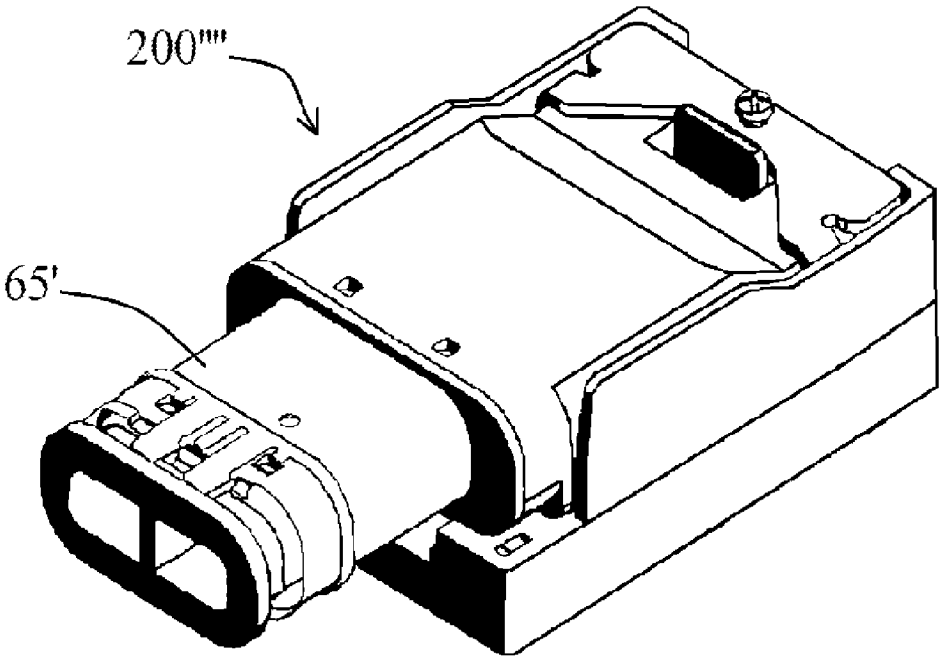
FIG. 20B is an example of a junction box that is dust- and watertight in accordance with protection class IP68.
Figure 20A:
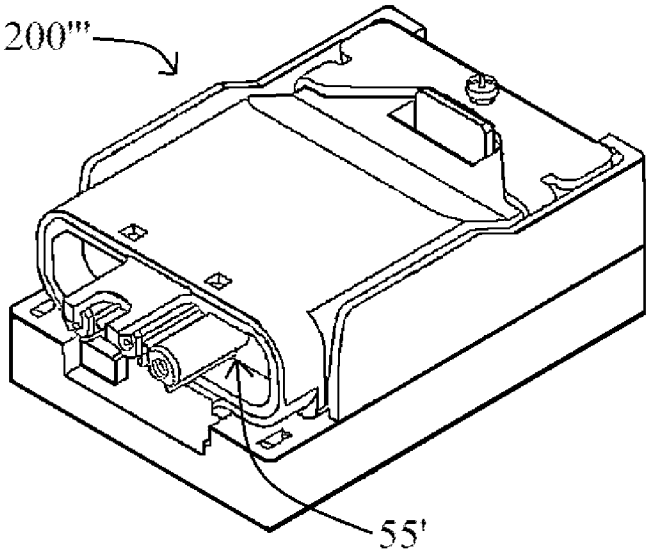
FIG. 20A is an example of a junction box that is dust- or watertight in accordance with protection class IP40.

A junction box 200''', provided to ensure class IP40 protection against the entrance of dust or water, is shown in FIG. 20A. This junction box 200''' is provided with a socket attachment 55' which surrounds the terminals 5 (see, for example, FIG. 4) for this very purpose.

An alternative junction box 200'''' provided for class IP65 protection against the entrance of water and dust, is shown in FIG. 20B. This junction box 200'''' is provided with a sealing attachment 65' which—possibly in addition to any socket attachments 55, 55' (see FIG. 16, FIG. 20A)—seals the junction box 200'.

An embodiment of a junction box 200 together with a plug 300 that can be coupled to its connection 550 and an outlet for a round cable 400 that connects to the plug is shown in FIGS. 21 and 22.

Here, the plug 300 from the example given in FIG. 21 is disconnected from the junction box 220. An outlet for a round cable 400 is connected to the plug 300. The flat cable 100 is routed through the junction box 200. In FIG. 21 and FIG. 22, the sleeve 60 to the lever element 80 is shown from above. The bushing attachment 55, 55' protrudes from the sleeve 60. The plug 300 is opposite the connection 550. The plug 300 can be present in different variants 300', 300'', 300'''. Such variants are shown schematically in FIG. 21.

In the situation illustrated by FIG. 22, the plug 300 is plugged into the connection 550 (see FIG. 21) of the junction box 200. The variant shown here provides protection against the entrance of dust or water in accordance with protection class IP40. Additionally shown is a sealing attachment 65 which, when connected to the sleeve 60, would provide corresponding protection in accordance with protection class IP68.

The illustration is only exemplary, so that larger or smaller numbers of individual parts may be provided, for example, or some parts may be omitted entirely.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. A junction box for connecting a multi-wire flat cable to several terminals of a connection, wherein the junction box comprises:

a support surface for a multi-wire flat cable to be contacted;

a plurality of contact blades for single-sided, stripping-free contacting of several wires of the multi-wire flat cable;

a plurality of terminals; and a plurality of terminal rails adjoining the terminals, wherein each terminal rail has at least one hole, wherein a contact pin is inserted through one hole in a terminal rail in each case, wherein a contact pin is provided in each case for a wire-to-terminal contact, wherein an assignment of contact pins to the holes in the terminal rails defines which wire of the multi-wire flat cable is connected to which terminal, wherein electrical contact is made between one or more contact blades and one or more terminal rails via one or more contact pins, and wherein the junction box comprises cross-connectors, wherein the cross-connectors establish the electrical connection between the contact pins and the contact blades, wherein the cross-connectors comprise a row with several first holes, wherein positioning the contact blades in the corresponding holes determines which cross-connector is connected to which contact blade and thus to which cable wire of the multi-wire flat cable to be contacted or tapped.

2. The junction box in accordance with claim 1, wherein the cross-connectors comprise a row with several second holes in which the contact pins extending from the terminal rails are received.

3. The junction box in accordance with claim 2, wherein each terminal rail comprises a row with several holes arranged in succession, wherein the contact pins extend from a hole in a terminal rail to a hole in a cross-connector to make the electrical connection from a particular terminal rail to a particular cross-connector.

4. The junction box in accordance with claim 3, wherein the junction box comprises a slide-in insulator positioned between the cross-connectors and the terminal rails.

5. The junction box in accordance with claim 4, wherein the cross-connectors are attached to the side of the slide-in insulator facing the multi-wire flat cable to be contacted and the terminal rails are attached to the opposite side of the slide-in insulator.

6. The junction box in accordance with claim 4, wherein the slide-in insulator is provided with holes only at those positions at which contact pins are inserted through the insulating body from the terminal elements to the cross-connectors, so that the positioning of the contact pins in the holes in the terminal connectors and the holes in the cross-connectors is predetermined by a hole coding on the slide-in insulator.

7. The junction box in accordance with claim 4, wherein the slide-in insulator is provided with contact pins permanently inserted at certain positions, which determine an electrical connection between certain terminal rails and certain cross-connectors.

8. The junction box in accordance with claim 4, wherein the contact pins are fixedly anchored in an electrically insulating pin plate such that the arrangement of the contact pins corresponds to the desired connection of wires in the multi-wire flat cable to the terminals and the electrical contact between the contact blades and the terminal rails is effected by pressing the pin plate onto the terminal rails, wherein, during the pressing, the contact pins are driven through the holes of the terminal rail into the holes of the cross-connectors.

9. The junction box in accordance with claim 4, wherein the junction box is constructed in several parts, wherein a first part comprises a sleeve, wherein a slide-in unit comprising the slide-in insulator, terminal rails with inserted contact pins, and cross-connectors with inserted contact blades is inserted into the sleeve, so that the contact blades protrude from the sleeve on its side facing the support surface for the multi-wire flat cable, and wherein a second part comprises the support surface for the multi-wire flat cable, as well as a receptacle for the first part with side walls, in which the sleeve of the first part is inserted for contacting the multi-wire flat cable, and wherein a lever element is provided in order to press the sleeve together with the protruding contact blades in the direction of the support surface for the multi-wire flat cable in order to contact the multi-wire flat cable.

10. The junction box in accordance with claim 1, wherein the junction box is adapted to connect a first and a second flat cable having five wires each, wherein three of the wires are phase conductors, one wire is a neutral conductor, and another wire is a grounding conductor, and correspondingly five contact blades, five cross-connectors, five terminals with associated terminal rail, and five contact pins are provided to connect respective phase conductors, neutral conductors and grounding conductors of the first flat cable to the terminals for the respective phase conductors, neutral conductors and grounding conductors of the second flat cable.

11. The junction box in accordance with claim 10, wherein the junction box is adapted to connect two data conductors of the multi-wire flat cables in addition to the five conductors of the first and second multi-wire flat cables, wherein contact blades, cross-connectors, terminal connectors and contact pins are provided, respectively, to connect the respective data conductors of the first flat cable to the respective terminals for the data conductors of the second flat cable.

12. The junction box in accordance with claim 1, wherein the terminals belong to a connection which is a connection for a round cable or for a flat cable.

13. The junction box in accordance with claim 1, wherein the terminals are arranged at right angles to the first flat cable resting on the support surface and thus a connection can be created between two flat cables arranged perpendicular to each other, or wherein the terminals are arranged parallel to the first flat cable resting on the support surface and thus a connection can be created between two flat cables arranged parallel one above the other.

14. An installation kit, wherein the installation kit comprises:

at least one through-line comprising a flat cable;

at least one connection line;

at least one junction box, which connects the through-line to the connection line, wherein the junction box comprises:

a support surface for a multi-wire flat cable to be contacted;

a plurality of contact blades for single-sided, stripping-free contacting of several wires of the multi-wire flat cable;

a plurality of terminals; and a plurality of terminal rails adjoining the terminals, wherein each terminal rail has at least one hole, wherein a contact pin is inserted through one hole in a terminal rail in each case, wherein a contact pin is provided in each case for wire-to-terminal contact, wherein an assignment of contact pins to the holes in the terminal rails defines which wire of the multi-wire flat cable is connected to which terminal, wherein electrical contact is made between one or more contact blades and one or more terminal rails via one or more contact pins, and wherein the junction box comprises cross-connectors, wherein the cross-connectors establish the electrical connection between the contact pins and the contact blades, wherein the cross-connectors comprise a row with several first holes, wherein positioning the contact blades in the corresponding holes determines which cross-connector is connected to which contact blade and thus to which cable wire of the multi-wire flat cable to be contacted or tapped.

* * * * *